US011794052B2

(12) United States Patent
Olson et al.

(10) Patent No.: US 11,794,052 B2
(45) Date of Patent: Oct. 24, 2023

(54) CABLE EXERCISE MACHINE

(71) Applicant: iFIT Inc., Logan, UT (US)

(72) Inventors: Michael L. Olson, Providence, UT (US); William T. Dalebout, North Logan, UT (US)

(73) Assignee: iFIT Inc., Logan, UT (US)

( * ) Notice: Subject to any disclaimer, the term of this patent is extended or adjusted under 35 U.S.C. 154(b) by 510 days.

(21) Appl. No.: 17/008,148

(22) Filed: Aug. 31, 2020

(65) Prior Publication Data

US 2020/0391069 A1 Dec. 17, 2020

Related U.S. Application Data

(63) Continuation of application No. 16/258,356, filed on Jan. 25, 2019, now Pat. No. 10,758,767, which is a (Continued)

(51) Int. Cl.
*A63B 21/00* (2006.01)
*A63B 21/005* (2006.01)
(Continued)

(52) U.S. Cl.
CPC .... *A63B 21/00192* (2013.01); *A63B 21/0051* (2013.01); *A63B 21/153* (2013.01); *A63B 21/154* (2013.01); *A63B 21/225* (2013.01); *A63B 21/4035* (2015.10); *A63B 21/4043* (2015.10); *A63B 23/03541* (2013.01); *A63B 23/03566* (2013.01); *A63B 23/1245* (2013.01);
(Continued)

(58) Field of Classification Search
CPC ..... A63B 21/00192; A63B 21/0051; A63B 21/153; A63B 21/154; A63B 21/225; A63B 21/4035; A63B 21/4043; A63B 23/03541; A63B 23/03566; A63B 23/1245; A63B 24/0062; A63B 24/0087; A63B 71/0622; A63B 2220/17; A63B 2220/40; A63B 2220/805; A63B 2230/75
See application file for complete search history.

(56) References Cited

U.S. PATENT DOCUMENTS 3,123,646 A 3/1964 Easton
3,579,339 A 5/1971 Chang
(Continued)

FOREIGN PATENT DOCUMENTS

CN 2172137 Y 7/1994
CN 2291169 Y 6/1998
(Continued)

OTHER PUBLICATIONS

Tonal Systems, Inc. v. ICON Health & Fitness, Inc., Case No. DDE-1-20-cv-01197, Complaint for Declaratory Judgment filed Sep. 8, 2020, 6 pages.
(Continued)

*Primary Examiner* — Sundhara M Ganesan
(74) *Attorney, Agent, or Firm* — RAY QUINNEY & NEBEKER P.C.; Paul N. Taylor

(57) ABSTRACT

A cable exercise machine includes a first pull cable and a second pull cable incorporated into a frame. Each of the first pull cable and the second pull cable are linked to at least one resistance mechanism. The at least one resistance mechanism includes a flywheel and a magnetic unit arranged to resist movement of the flywheel.

20 Claims, 7 Drawing Sheets

Related U.S. Application Data continuation of application No. 15/976,496, filed on May 10, 2018, now Pat. No. 10,188,890, which is a continuation of application No. 15/696,841, filed on Sep. 6, 2017, now Pat. No. 9,968,816, which is a continuation of application No. 15/226,703, filed on Aug. 2, 2016, now Pat. No. 9,757,605, which is a continuation of application No. 14/582,493, filed on Dec. 24, 2014, now Pat. No. 9,403,047.

(60) Provisional application No. 61/920,834, filed on Dec. 26, 2013.

(51) Int. Cl.

| | |
|---|---|
| ***A63B 21/22*** | (2006.01) |
| ***A63B 23/035*** | (2006.01) |
| ***A63B 23/12*** | (2006.01) |
| ***A63B 24/00*** | (2006.01) |
| ***A63B 71/06*** | (2006.01) |

(52) U.S. Cl.

CPC ..... *A63B 24/0062* (2013.01); *A63B 24/0087* (2013.01); *A63B 71/0622* (2013.01); *A63B 2220/17* (2013.01); *A63B 2220/40* (2013.01); *A63B 2220/805* (2013.01); *A63B 2230/75* (2013.01)

(56) References Cited

U.S. PATENT DOCUMENTS

| | | | |
|---|---|---|---|
| 3,926,430 | A | 12/1975 | Good, Jr. |
| 4,533,136 | A | 8/1985 | Smith et al. |
| 4,725,057 | A | 2/1988 | Shifferaw |
| 4,968,028 | A | 11/1990 | Wehrell |
| 5,000,442 | A | 1/1991 | Dalebout et al. |
| 5,039,091 | A | 8/1991 | Johnson |
| 5,286,243 | A | 2/1994 | Lapcevic |
| 5,344,376 | A | 9/1994 | Bostic et al. |
| 5,354,252 | A | 10/1994 | Habing |
| D352,536 | S | 11/1994 | Byrd et al. |
| 5,362,298 | A | 11/1994 | Brown |
| 5,409,435 | A | 4/1995 | Daniels |
| 5,484,358 | A | 1/1996 | Wang et al. |
| 5,527,245 | A | 6/1996 | Dalebout et al. |
| 5,588,938 | A | 12/1996 | Schnider et al. |
| 5,830,113 | A | 11/1998 | Coody et al. |
| 6,027,429 | A | 2/2000 | Daniels |
| 6,030,320 | A | 2/2000 | Stearns et al. |
| 6,030,321 | A | 2/2000 | Fuentes |
| 6,123,649 | A | 9/2000 | Lee et al. |
| D457,580 | S | 5/2002 | Webber |
| 6,436,008 | B1 | 8/2002 | Skowronski et al. |
| 6,454,679 | B1 | 9/2002 | Radow |
| 6,488,612 | B2 | 12/2002 | Sechrest |
| 6,491,610 | B1 | 12/2002 | Henn |
| 6,599,223 | B2 | 7/2003 | Wang |
| 6,669,607 | B2 | 12/2003 | Slawinski |
| 6,699,159 | B2 | 3/2004 | Rouse |
| 6,746,371 | B1 | 6/2004 | Brown et al. |
| 6,811,520 | B2 | 11/2004 | Wu |
| 6,837,830 | B2 | 1/2005 | Eldridge |
| 6,857,993 | B2 | 2/2005 | Yeh |
| 6,958,032 | B1 | 10/2005 | Smith |
| D511,190 | S | 11/2005 | Panatta |
| D512,113 | S | 11/2005 | Carter |
| 7,011,326 | B1 | 3/2006 | Schroeder et al. |
| D520,085 | S | 5/2006 | Willardson et al. |
| 7,226,402 | B1 | 6/2007 | Joya |
| D552,193 | S | 10/2007 | Husted et al. |
| 7,311,640 | B2 | 12/2007 | Baatz |
| 7,364,538 | B2 | 4/2008 | Aucamp |
| 7,381,161 | B2 | 6/2008 | Ellis |
| 7,524,272 | B2 | 4/2009 | Burck et al. |
| 7,540,828 | B2 | 6/2009 | Watterson et al. |
| 7,575,537 | B2 | 8/2009 | Ellis |
| 7,584,673 | B2 | 9/2009 | Shimizu |
| 7,604,572 | B2 | 10/2009 | Stanford |
| 7,641,597 | B2 | 1/2010 | Schmidt |
| 7,740,563 | B2 | 6/2010 | Dalebout et al. |
| D633,581 | S | 3/2011 | Thulin |
| 7,942,793 | B2 | 5/2011 | Mills et al. |
| 8,029,425 | B2 | 10/2011 | Bronston et al. |
| 8,070,657 | B2 | 12/2011 | Loach |
| 8,096,926 | B1 | 1/2012 | Batca |
| 8,398,529 | B2 | 3/2013 | Ellis et al. |
| 8,500,607 | B2 | 8/2013 | Vittone et al. |
| 8,517,899 | B2 | 8/2013 | Zhou |
| 8,550,964 | B2 | 10/2013 | Ish, III et al. |
| 8,764,609 | B1 | 7/2014 | Elahmadie |
| 8,808,152 | B1 | 8/2014 | Midgett |
| 8,986,165 | B2 | 3/2015 | Ashby |
| 9,011,291 | B2 | 4/2015 | Birrell |
| 9,044,635 | B2 | 6/2015 | Lull |
| 9,170,223 | B2 | 10/2015 | Hyun |
| D746,388 | S | 12/2015 | Hockridge |
| 9,211,433 | B2 | 12/2015 | Hall |
| 9,254,409 | B2 | 2/2016 | Dalebout et al. |
| 9,393,453 | B2 | 7/2016 | Watterson |
| 9,403,047 | B2 | 8/2016 | Olson et al. |
| 9,415,257 | B2 | 8/2016 | Habing |
| 9,468,793 | B2 | 10/2016 | Salmon |
| 9,511,259 | B2 | 12/2016 | Mountain |
| 9,539,458 | B1 | 1/2017 | Ross |
| 9,616,276 | B2 | 4/2017 | Dalebout et al. |
| 9,662,529 | B2 | 5/2017 | Miller et al. |
| 9,700,751 | B2 | 7/2017 | Verdi |
| 9,757,605 | B2 | 9/2017 | Olson et al. |
| D807,445 | S | 1/2018 | Gettle |
| 9,878,200 | B2 | 1/2018 | Edmondson |
| 9,968,816 | B2 | 5/2018 | Olson et al. |
| 10,188,890 | B2 | 1/2019 | Olson et al. |
| 10,258,828 | B2 | 4/2019 | Dalebout |
| 10,279,212 | B2 | 5/2019 | Dalebout et al. |
| 10,293,211 | B2 | 5/2019 | Watterson et al. |
| 10,388,183 | B2 | 8/2019 | Watterson |
| 10,391,361 | B2 | 8/2019 | Watterson |
| 10,426,989 | B2 | 10/2019 | Dalebout |
| 10,433,612 | B2 | 10/2019 | Ashby |
| 10,441,840 | B2 | 10/2019 | Dalebout et al. |
| D868,090 | S | 12/2019 | Cutler et al. |
| D868,909 | S | 12/2019 | Cutler |
| 10,492,519 | B2 | 12/2019 | Capell |
| 10,493,349 | B2 | 12/2019 | Watterson |
| 10,500,473 | B2 | 12/2019 | Watterson |
| 10,543,395 | B2 | 1/2020 | Powell et al. |
| 10,561,877 | B2 | 2/2020 | Workman |
| 10,561,893 | B2 | 2/2020 | Chatterton |
| 10,561,894 | B2 | 2/2020 | Dalebout |
| 10,569,121 | B2 | 2/2020 | Watterson |
| 10,569,123 | B2 | 2/2020 | Hochstrasser |
| 10,668,320 | B2 | 6/2020 | Watterson |
| 10,709,925 | B2 | 7/2020 | Dalebout et al. |
| 10,758,767 | B2 | 9/2020 | Olson et al. |
| 10,953,268 | B1 | 3/2021 | Dalebout et al. |
| 10,967,214 | B1 | 4/2021 | Olson et al. |
| 10,994,173 | B2 | 5/2021 | Watterson |
| 11,058,913 | B2 | 7/2021 | Dalebout et al. |
| 2001/0016542 | A1 | 8/2001 | Yoshimura |
| 2002/0002104 | A1 | 1/2002 | Panatta |
| 2002/0013200 | A1 | 1/2002 | Sechrest |
| 2002/0025888 | A1 | 2/2002 | Germanton |
| 2002/0086779 | A1 | 7/2002 | Wilkinson |
| 2003/0032528 | A1 | 2/2003 | Wu et al. |
| 2003/0032531 | A1 | 2/2003 | Simonson |
| 2003/0032535 | A1 | 2/2003 | Wang et al. |
| 2003/0045406 | A1 | 3/2003 | Stone |
| 2003/0171192 | A1 | 9/2003 | Wu et al. |
| 2003/0176261 | A1 | 9/2003 | Simonson et al. |
| 2003/0181293 | A1 | 9/2003 | Baatz |
| 2004/0043873 | A1 | 3/2004 | Wilkinson et al. |
| 2004/0102292 | A1 | 5/2004 | Pyles et al. |
| 2004/0176227 | A1 | 9/2004 | Endelman |

(56) References Cited

U.S. PATENT DOCUMENTS

| | | | |
|---|---|---|---|
| 2004/0204294 | A2 | 10/2004 | Wilkinson |
| 2005/0049117 | A1 | 3/2005 | Rodgers |
| 2005/0130814 | A1 | 6/2005 | Nitta et al. |
| 2005/0148445 | A1 | 7/2005 | Carle |
| 2005/0164837 | A1 | 7/2005 | Anderson et al. |
| 2006/0035755 | A1 | 2/2006 | Dalebout et al. |
| 2006/0035768 | A1 | 2/2006 | Kowalllis et al. |
| 2006/0148622 | A1 | 7/2006 | Chen |
| 2006/0240955 | A1 | 10/2006 | Pu |
| 2006/0252613 | A1 | 11/2006 | Barnes et al. |
| 2007/0037674 | A1 | 2/2007 | Finn et al. |
| 2007/0123395 | A1 | 5/2007 | Ellis |
| 2007/0173392 | A1 | 7/2007 | Stanford |
| 2007/0197346 | A1 | 8/2007 | Seliber |
| 2007/0232463 | A1 | 10/2007 | Wu |
| 2007/0287601 | A1 | 12/2007 | Burck et al. |
| 2008/0051256 | A1 | 2/2008 | Ashby et al. |
| 2008/0119337 | A1 | 5/2008 | Wilkins et al. |
| 2008/0242511 | A1 | 10/2008 | Munoz |
| 2009/0036276 | A1 | 2/2009 | Loach |
| 2010/0197462 | A1 | 8/2010 | Piane, Jr. |
| 2010/0255965 | A1 | 10/2010 | Chen |
| 2011/0009249 | A1 | 1/2011 | Campanaro et al. |
| 2011/0082013 | A1 | 4/2011 | Bastian |
| 2011/0281691 | A1 | 11/2011 | Ellis |
| 2012/0065034 | A1 | 3/2012 | Loach |
| 2012/0088638 | A1 | 4/2012 | Lull |
| 2012/0277068 | A1 | 11/2012 | Zhou et al. |
| 2013/0065732 | A1 | 3/2013 | Hopp |
| 2013/0090216 | A1 | 4/2013 | Jackson |
| 2013/0109543 | A1 | 5/2013 | Reyes |
| 2013/0123073 | A1 | 5/2013 | Olson et al. |
| 2013/0196821 | A1 | 8/2013 | Watterson et al. |
| 2013/0303334 | A1 | 11/2013 | Adhami et al. |
| 2013/0337981 | A1 | 12/2013 | Habing |
| 2014/0038777 | A1 | 2/2014 | Bird |
| 2014/0187389 | A1 | 7/2014 | Berg |
| 2014/0235409 | A1 | 8/2014 | Salmon et al. |
| 2014/0357457 | A1 | 12/2014 | Boekema |
| 2014/0371035 | A1 | 12/2014 | Mortensen et al. |
| 2015/0038300 | A1 | 2/2015 | Forhan et al. |
| 2015/0182779 | A1 | 7/2015 | Dalebout |
| 2015/0306440 | A1 | 10/2015 | Bucher et al. |
| 2015/0352396 | A1 | 12/2015 | Dalebout |
| 2016/0303453 | A1 | 10/2016 | Kim |
| 2017/0266481 | A1 | 9/2017 | Dalebout |
| 2017/0266533 | A1 | 9/2017 | Dalebout |
| 2017/0319941 | A1 | 11/2017 | Smith et al. |
| 2018/0154205 | A1 | 6/2018 | Watterson |
| 2018/0154209 | A1 | 6/2018 | Watterson |
| 2019/0151698 | A1 | 5/2019 | Olson et al. |
| 2019/0192898 | A1 | 6/2019 | Dalebout et al. |
| 2019/0232112 | A1 | 8/2019 | Dalebout |
| 2019/0269958 | A1 | 9/2019 | Dalebout et al. |
| 2019/0376585 | A1 | 12/2019 | Buchanan |
| 2020/0009417 | A1 | 1/2020 | Dalebout |
| 2020/0016459 | A1 | 1/2020 | Smith |
| 2020/0254295 | A1 | 8/2020 | Watterson |
| 2020/0254309 | A1 | 8/2020 | Watterson |
| 2020/0338389 | A1 | 10/2020 | Dalebout et al. |

FOREIGN PATENT DOCUMENTS

| | | | |
|---|---|---|---|
| CN | 101784308 | | 11/2001 |
| CN | 1658929 | | 8/2005 |
| CN | 1708333 | | 12/2005 |
| CN | 2841072 | Y | 11/2006 |
| CN | 201516258 | | 6/2010 |
| CN | 201410258 | Y | 2/2014 |
| CN | 103801048 | | 5/2014 |
| CN | 10488413 | | 9/2015 |
| CN | 105848733 | | 8/2016 |
| CN | 104884133 | B | 2/2018 |
| CN | 106470739 | B | 6/2019 |
| CN | 110035801 | | 7/2019 |
| EP | 1188460 | | 3/2002 |
| EP | 2969058 | | 1/2016 |
| EP | 3086865 | A1 | 11/2016 |
| EP | 3086865 | A1 | 1/2020 |
| EP | 3086865 | | 2/2020 |
| EP | 3623020 | | 3/2020 |
| EP | 2969058 | | 5/2020 |
| JP | 2002-011114 | | 1/2002 |
| JP | 2013543749 | | 12/2013 |
| KR | 100 766 822 | B1 | 10/2007 |
| KR | 20100133609 | A | 12/2010 |
| SU | 1533710 | | 1/1990 |
| TW | M464203 | | 11/2013 |
| TW | M495871 | | 2/2015 |
| TW | 201821129 | A | 6/2018 |
| TW | 201821130 | A | 6/2018 |
| TW | 201601802 | A | 12/2018 |
| WO | 1989002217 | | 3/1989 |
| WO | 1997006859 | | 2/1997 |
| WO | 2002053234 | A1 | 7/2002 |
| WO | 2007015096 | A3 | 2/2007 |
| WO | 2009/000059 | | 12/2008 |
| WO | 2009/014330 | | 1/2009 |
| WO | 2013/0124509 | A1 | 8/2013 |
| WO | 2014153158 | | 9/2014 |
| WO | 2015/100429 | | 7/2015 |
| WO | 2015191445 | | 12/2015 |
| WO | 2018106598 | | 6/2018 |
| WO | 2018106603 | | 6/2018 |

OTHER PUBLICATIONS

Tonal Systems, Inc. v. ICON Health & Fitness, Inc., Case No. DDE-1-20-cv-01197, Defendant's Answer and Counterclaims filed Sep. 30, 2020, 15 pages.

U.S. Appl. No. 61/920,834, filed Dec. 26, 2013, titled "Magnetic Resistance Mechanism in a Cable Machine", 31 pages.

Exxentric, Movie Archives, obtained from The Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

Nautilus, Inc. v. ICON Health & Fitness, Inc., Civil Case No. IPR2017-01363, Petition for Inter Partes Review of U.S. Pat. No. 9,403,047, filed May 5, 2017; 76 pages (paper 2).

Nautilus, Inc. v. ICON Health & Fitness, Inc., Civil Case No. IPR2017-01363, Olson, U.S. Pat. No. 9,403,047, 16 pages, (Petition EX. 1001).

Nautilus, Inc. v. ICON Health & Fitness, Inc., Civil Case No. IPR2017-01363, Sleamaker, U.S. Pat. No. 5,354,251, 14 pages, (Petition EX. 1002).

Nautilus, Inc. v. ICON Health & Fitness, Inc., Civil Case No. IPR2017-01363, Hanoun, U.S. Publication No. 2007-0232452, 28 pages, (Petition EX. 1003).

Nautilus, Inc. v. ICON Health & Fitness, Inc., Civil Case No. IPR2017-01363, Six-Pak, Printed Publication TuffStuff Fitness Six-Pak Trainer Owner's Manual, 19 pages, (Petition EX 1004).

Nautilus, Inc. v. ICON Health & Fitness, Inc., Civil Case No. IPR2017-01363, Ehrenfried, U.S. Pat. No. 5,738,611, 19 pages, (Petition EX. 1005).

Nautilus, Inc. v. ICON Health & Fitness, Inc., Civil Case No. IPR2017-01363, Kleinman, International Publication No. WO2008/152627, 65 pages, (Petition EX. 1006).

Nautilus, Inc. v. ICON Health & Fitness, Inc., Civil Case No. IPR2017-01363, Declaration of Lee Rawls, (Petition EX. 1007).

Nautilus, Inc. v. ICON Health & Fitness, Inc., Civil Case No. IPR2017-01363, U.S. Pat. No. 9,403,047 File history, 130 pages, (Petition EX. 1008).

Nautilus, Inc. v. ICON Health & Fitness, Inc., Civil Case No. IPR2017-01363, U.S. Appl. No. 61/920,834, 38 pages, (Petition EX. 1009).

Nautilus, Inc. v. ICON Health & Fitness, Inc., Civil Case No. IPR2017-01363, Declaration of Christopher Butler, 26 pages, (Petition EX. 1010).

(56) References Cited

OTHER PUBLICATIONS

Nautilus, Inc. v. ICON Health & Fitness, Inc., Civil Case No. IPR2017-01363, Petitioner's Power of Attorney, filed May 5, 2017, 2 pages (paper 2).
Nautilus, Inc. v. ICON Health & Fitness, Inc., Civil Case No. IPR2017-01363, Mandatory Notice to Patent Owner, filed May 19, 2017, 4 pages (paper 3).
Nautilus, Inc. v. ICON Health & Fitness, Inc., Civil Case No. IPR2017-01363, Power of Attorney, filed May 19, 2017, 3 pages (paper 4).
Nautilus, Inc. v. ICON Health & Fitness, Inc., Civil Case No. IPR2017-01363, Notice of Accord Filing Date, filed Jun. 9, 2017, 5 pages (paper 5).
U.S. Appl. No. 61/786,007, filed Mar. 14, 2013, titled "Strength Training Apparatus with Flywheel and Related Methods", 28 pages.
U.S. Appl. No. 62/009,607, filed Jun. 9, 2014, titled "Cable System Incorporated into a Treadmill", 32 pages.
International Search Report & Written Opinion for PCT Application No. PCT/US2014/029353, dated Aug. 4, 2014, 9 pages.
Supplemental European Search Report for European Application No. 14768130, dated Oct. 11, 2016, 9 pages.
U.S. Appl. No. 15/472,954, filed Mar. 29, 2017, titled "Strength Training Apparatus with Flywheel and Related Methods", 22 pages.
U.S. Appl. No. 15/976,496, filed May 10, 2018, titled "Magnetic Resistance Mechanism in a Cable Machine", 36 pages.
Nautilus, Inc. v. ICON Health & Fitness, Inc., Civil Case No. IPR2017-01407, Petition for Inter Partes Review of U.S. Pat. No. 9,616,276 (Claims 1-4, 7-10), filed May 5, 2017.
Nautilus, Inc. v. ICON Health & Fitness, Inc., Civil Case No. IPR2017-01407, Dalebout et al., U.S. Pat. No. 9,616,276, (Petition EX. 1001).
Nautilus, Inc. v. ICON Health & Fitness, Inc., Civil Case No. IPR2017-01407, Wu, U.S. Publication No. 20030171192, (Petition EX. 1002).
Nautilus, Inc. v. ICON Health & Fitness, Inc., Civil Case No. IPR2017-01407, Webb, U.S. Publication No. 20030017918, (Petition EX. 1003).
Nautilus, Inc. v. ICON Health & Fitness, Inc., Civil Case No. IPR2017-01407, Watson, U.S. Publication No. 20060234840, (Petition EX. 1004).
Nautilus, Inc. v. ICON Health & Fitness, Inc., Civil Case No. IPR2017-01407, Jones, U.S. Pat. No. 4,798,378, (Petition EX. 1005).
Nautilus, Inc. v. ICON Health & Fitness, Inc., Civil Case No. IPR2017-01407, Zhou et al., U.S. Pat. No. 8,517,899, (Petition EX. 1006).
Nautilus, Inc. v. ICON Health & Fitness, Inc., Civil Case No. IPR2017-01407, Loach, U.S. Publication No. WO2007015096, (Petition EX. 1007).
Nautilus, Inc. v. ICON Health & Fitness, Inc., Civil Case No. IPR2017-01407, Rawls Declaration, Part 1 & 2, (Petition EX. 1008).
Nautilus, Inc. v. ICON Health & Fitness, Inc., Civil Case No. IPR2017-01407, U.S. Pat. No. 9,616,276 File History, (Petition EX. 1009).
Nautilus, Inc. v. ICON Health & Fitness, Inc., Civil Case No. IPR2017-01407, U.S. Appl. No. 61/786,007 File History, (Petition EX. 1010).
Nautilus, Inc. v. ICON Health & Fitness, Inc., Civil Case No. IPR2017-01407, Sawicky, U.S. Pat. No. 5,042,798, (Petition EX. 1011).
Nautilus, Inc. v. ICON Health & Fitness, Inc., Civil Case No. IPR2017-01407, Petitioner's Power of Attorney, filed May 5, 2017.
Nautilus, Inc. v. ICON Health & Fitness, Inc., Civil Case No. IPR2017-01407, Mandatory Notice to Patent Owner, filed May 19, 2017.
Nautilus, Inc. v. ICON Health & Fitness, Inc., Civil Case No. IPR2017-01407, Power of Attorney, filed May 19, 2017.
Nautilus, Inc. v. ICON Health & Fitness, Inc., Civil Case No. IPR2017-01407, Notice of Accord Filing Date, filed Jun. 6, 2017.
Nautilus, Inc. v. ICON Health & Fitness, Inc., Civil Case No. IPR2017-01408, Petition for Inter Partes Review of U.S. Pat. No. 9,616,276 (Claims 1-20) filed May 5, 2017.
Nautilus, Inc. v. ICON Health & Fitness, Inc., Civil Case No. IPR2017-01408, Dalebout et al., U.S. Pat. No. 9,616,276, (Petition EX. 1001).
Nautilus, Inc. v. ICON Health & Fitness, Inc., Civil Case No. IPR2017-01408, Wu, U.S. Publication No. 20030171192, (Petition EX. 1002).
Nautilus, Inc. v. ICON Health & Fitness, Inc., Civil Case No. IPR2017-01408, Webb, U.S. Publication No. 20030017918, (Petition EX. 1003).
Nautilus, Inc. v. ICON Health & Fitness, Inc., Civil Case No. IPR2017-01408, Watson, U.S. Publication No. 20060234840, (Petition EX. 1004).
Nautilus, Inc. v. ICON Health & Fitness, Inc., Civil Case No. IPR2017-01408, Jones, U.S. Pat. No. 4,798,378, (Petition EX. 1005).
Nautilus, Inc. v. ICON Health & Fitness, Inc., Civil Case No. IPR2017-01408, Zhou et al., U.S. Pat. No. 8,517,899, (Petition EX. 1006).
Nautilus, Inc. v. ICON Health & Fitness, Inc., Civil Case No. IPR2017-01408, Loach, U.S. Publication No. WO2007015096, (Petition EX. 1007).
Nautilus, Inc. v. ICON Health & Fitness, Inc., Civil Case No. IPR2017-01408, Rawls Declaration, Part 1 & 2, (Petition EX. 1008).
Nautilus, Inc. v. ICON Health & Fitness, Inc., Civil Case No. IPR2017-01408, U.S. Pat. No. 9,616,276 File History, (Petition EX. 1009).
Nautilus, Inc. v. ICON Health & Fitness, Inc., Civil Case No. IPR2017-01408, U.S. Appl. No. 61/786,007 File History, (Petition EX. 1010).
Nautilus, Inc. v. ICON Health & Fitness, Inc., Civil Case No. IPR2017-01408, Sawicky, U.S. Pat. No. 5,042,798, (Petition EX. 1011).
Nautilus, Inc. v. ICON Health & Fitness, Inc., Civil Case No. IPR2017-01408, Petitioner's Power of Attorney, filed May 5, 2017.
Nautilus, Inc. v. ICON Health & Fitness, Inc., Civil Case No. IPR2017-01408, Mandatory Notice to Patent Owner, filed May 19, 2017.
Nautilus, Inc. v. ICON Health & Fitness, Inc., Civil Case No. IPR2017-01408, Power of Attorney, filed May 19, 2017.
Nautilus, Inc. v. ICON Health & Fitness, Inc., Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
Nautilus, Inc. v. ICON Health & Fitness, Inc., Civil Case No. IPR2017-01363, Declaration of Tyson Hottinger in Support of Motion for Admission PRO HAC VICE, filed Feb. 1, 2018 (Ex 2001).
Nautilus, Inc. v. ICON Health & Fitness, Inc., Civil Case No. IPR2017-01363, Transcript of Deposition of R. Lee Rawls, filed Mar. 5, 2018 (Ex 2002).
Nautilus, Inc. v. ICON Health & Fitness, Inc., Civil Case No. IPR2017-01363, Order Conduct of Proceedings, filed May 7, 2018 (Paper 20).
Nautilus, Inc. v. ICON Health & Fitness, Inc., Civil Case No. IPR2017-01407, Decision Institution of Inter Partes Review, filed Dec. 4, 2017 (Paper 6).
Nautilus, Inc. v. ICON Health & Fitness, Inc., Civil Case No. IPR2017-01407, Scheduling Order, filed Dec. 4, 2017 (Paper 7).
Nautilus, Inc. v. ICON Health & Fitness, Inc., Civil Case No. IPR2017-01407, Order, filed Jan. 19, 2018 (Paper 8).
Nautilus, Inc. v. ICON Health & Fitness, Inc., Civil Case No. IPR2017-01407, Patent Owner's Notice of Deposition of R. Lee Rawls, filed Jan. 19, 2018 (Paper 9).
Nautilus, Inc. v. ICON Health & Fitness, Inc., Civil Case No. IPR2017-01407, Unopposed Motion for Pro Hac Vice Admission of Tyson Hottinger, filed Feb. 1, 2018 (Paper 10).

(56) References Cited

OTHER PUBLICATIONS

Nautilus, Inc. v. ICON Health & Fitness, Inc., Civil Case No. IPR2017-01407, Patent Owner's Current Exhibit List, filed Feb. 1, 2018 (Paper 11).
Nautilus, Inc. v. ICON Health & Fitness, Inc., Civil Case No. IPR2017-01407, Patent Owner's Updated Notice of Deposition of R. Lee Rawls, filed Feb. 1, 2018 (Paper 12).
Nautilus, Inc. v. ICON Health & Fitness, Inc., Civil Case No. IPR2017-01407, Order Granting Motion of Pro Hac Vice Admission of Mr. Hottinger, filed Feb. 12, 2018 (Paper 13).
Nautilus, Inc. v. ICON Health & Fitness, Inc., Civil Case No. IPR2017-01407, Petitioner's Updated Mandatory Notices, filed Feb. 20, 2018 (Paper 14).
Nautilus, Inc. v. ICON Health & Fitness, Inc., Civil Case No. IPR2017-01407, Petitioner's Updated Power of Attorney, filed Feb. 20, 2018 (Paper 15).
Nautilus, Inc. v. ICON Health & Fitness, Inc., Civil Case No. IPR2017-01407, Patent Owner's Motion to Amend, filed Mar. 5, 2018 (Paper 16).
Nautilus, Inc. v. ICON Health & Fitness, Inc., Civil Case No. IPR2017-01407, Current Exhibit List of Patent Owner, filed Mar. 5, 2018 (Paper 17).
Nautilus, Inc. v. ICON Health & Fitness, Inc., Civil Case No. IPR2017-01407, Order Conduct of Proceedings 37 C.F.R. Sec 42.5, filed Apr. 27, 2018 (Paper 18).
Nautilus, Inc. v. ICON Health & Fitness, Inc., Civil Case No. IPR2017-01407, Order Conduct of Proceedings 37 C.F.R. Sec 42.5, filed May 7, 2018 (Paper 19).
Nautilus, Inc. v. ICON Health & Fitness, Inc., Civil Case No. IPR2017-01407, Declaration of Tyson Hottinger in Support of Motion for Admission PRO HAC VICE, (Patent Owner EX. 2001).
Nautilus, Inc. v. ICON Health & Fitness, Inc., Civil Case No. IPR2017-01407, Claim Listing of Proposed Substitute Claims for Patent Owner Motion to Amend, (Patent Owner EX. 2002).
Nautilus, Inc. v. ICON Health & Fitness, Inc., Civil Case No. IPR2017-01407, Specification of U.S. Pat. No. 9,616,276, (Patent Owner EX. 2003).
Nautilus, Inc. v. ICON Health & Fitness, Inc., Civil Case No. IPR2017-01407, Drawings of U.S. Pat. No. 9,616,276, (Patent Owner EX. 2004).
Nautilus, Inc. v. ICON Health & Fitness, Inc., Civil Case No. IPR2017-01407, Specification of U.S. Pat. No. 9,254,409 (Patent Owner EX. 2005).
Nautilus, Inc. v. ICON Health & Fitness, Inc., Civil Case No. IPR2017-01407, Drawings of U.S. Pat. No. 9,254,409 (Patent Owner EX. 2006).
Nautilus, Inc. v. ICON Health & Fitness, Inc., Civil Case No. IPR2017-01407, Provisional Patent Specification of U.S. Appl. No. 61/786,007, (Patent Owner EX. 2007).
Nautilus, Inc. v. ICON Health & Fitness, Inc., Civil Case No. IPR2017-01407, Provisional Patent Drawings of U.S. Appl. No. 61/786,007, (Patent Owner EX. 2008).
Nautilus, Inc. v. ICON Health & Fitness, Inc., Civil Case No. IPR2017-01407, Specification of U.S. Appl. No. 13/754,361 (Patent Owner EX. 2009).
Nautilus, Inc. v. ICON Health & Fitness, Inc., Civil Case No. IPR2017-01407, Drawings of U.S. Appl. No. 13/754,361 (Patent Owner EX. 2010).
Nautilus, Inc. v. ICON Health & Fitness, Inc., Civil Case No. IPR2017-01407, Webster Dictionary p. 2211 (Merriam-Webster, Inc. 1961, 2002) (EX. 3001).
Nautilus, Inc. v. ICON Health & Fitness, Inc., Civil Case No. IPR2017-01408, Patent Owner Preliminary Response to Petition, filed Sep. 5, 2017 (Paper 6).
Nautilus, Inc. v. ICON Health & Fitness, Inc., Civil Case No. IPR2017-01408, Decision Institution of Inter Partes Review, filed Dec. 4, 2017 (Paper 7).
Nautilus, Inc. v. ICON Health & Fitness, Inc., Civil Case No. IPR2017-01408, Scheduling Order, filed Dec. 4, 2017 (Paper 8).
Nautilus, Inc. v. ICON Health & Fitness, Inc., Civil Case No. IPR2017-01408, Order Conduct of Proceeding, filed Jan. 19, 2018 (Paper 9).
Nautilus, Inc. v. ICON Health & Fitness, Inc., Civil Case No. IPR2017-01408, Patent Owner's Notice of Deposition of R. Lee Rawls, filed Jan. 19, 2018 (Paper 10).
Nautilus, Inc. v. ICON Health & Fitness, Inc., Civil Case No. IPR2017-01408, Unopposed Motion for PRO HAC VICE Admission of Tyson Hottinger, filed Feb. 1, 2018 (Paper 11).
Nautilus, Inc. v. ICON Health & Fitness, Inc., Civil Case No. IPR2017-01408, Current Exhibit List for Patent Owner, filed Feb. 1, 2018 (Paper 12).
Nautilus, Inc. v. ICON Health & Fitness, Inc., Civil Case No. IPR2017-01408, Patent Owner's Updated Notice of Deposition of R. Lee Rawls, Feb. 1, 2018 (Paper 13).
Nautilus, Inc. v. ICON Health & Fitness, Inc., Civil Case No. IPR2017-01408, Order Granting Motion for PRO HAC VICE Admission, filed Feb. 12, 2018 (Paper 14).
Nautilus, Inc. v. ICON Health & Fitness, Inc., Civil Case No. IPR2017-01408, Petitioner's Updated Mandatory Notices, filed Feb. 20, 2018 (Paper 15).
Nautilus, Inc. v. ICON Health & Fitness, Inc., Civil Case No. IPR2017-01408, Petitioner's Updated Power of Attorney, filed Feb. 20, 2018 (Paper 16).
Nautilus, Inc. v. ICON Health & Fitness, Inc., Civil Case No. IPR2017-01408, Patent Owners Motion to Amend, filed Mar. 5, 2018 (Paper 17).
Nautilus, Inc. v. ICON Health & Fitness, Inc., Civil Case No. IPR2017-01408, Current Exhibit List of Patent Owner, filed Mar. 5, 2018 (Paper 18).
Nautilus, Inc. v. ICON Health & Fitness, Inc., Civil Case No. IPR2017-01408, Order Conduct of Proceedings, filed Apr. 27, 2018 (Paper 19).
Nautilus, Inc. v. ICON Health & Fitness, Inc., Civil Case No. IPR2017-01408, Order Conduct of Proceedings, filed May 7, 2018 (Paper 20).
Nautilus, Inc. v. ICON Health & Fitness, Inc., Civil Case No. IPR2017-01408, Declaration of Tyson Hottinger in Support of Motion for Admission PRO HAC VICE, (Patent Owner EX. 2001).
Nautilus, Inc. v. ICON Health & Fitness, Inc., Civil Case No. IPR2017-01408, Claim Listing of Proposed Substitute Claims for Patent Owner Motion to Amend, (Patent Owner EX. 2002).
Nautilus, Inc. v. ICON Health & Fitness, Inc., Civil Case No. IPR2017-01408, Specification of U.S. Appl. No. 15/019,088, (Patent Owner EX. 2003).
Nautilus, Inc. v. ICON Health & Fitness, Inc., Civil Case No. IPR2017-01408, Drawings of U.S. Appl. No. 15/019,088, (Patent Owner EX. 2004).
Nautilus, Inc. v. ICON Health & Fitness, Inc., Civil Case No. IPR2017-01408, Specification of U.S. Appl. No. 14/213,793, (Patent Owner EX. 2005).
Nautilus, Inc. v. ICON Health & Fitness, Inc., Civil Case No. IPR2017-01408, Drawings of U.S. Appl. No. 14/213,793, (Patent Owner EX. 2006).
Nautilus, Inc. v. ICON Health & Fitness, Inc., Civil Case No. IPR2017-01408, Specification of U.S. Appl. No. 61/786,007, (Patent Owner EX. 2007).
Nautilus, Inc. v. ICON Health & Fitness, Inc., Civil Case No. IPR2017-01408, Drawings of U.S. Appl. No. 61/786,007, (Patent Owner EX. 2008).
Nautilus, Inc. v. ICON Health & Fitness, Inc., Civil Case No. IPR2017-01408, Specification of U.S. Appl. No. 13/754,361, (Patent Owner EX. 2009).
Nautilus, Inc. v. ICON Health & Fitness, Inc., Civil Case No. IPR2017-01408, Drawings of U.S. Appl. No. 13/754,361, (Patent Owner EX. 2010).
Nautilus, Inc. v. ICON Health & Fitness, Inc., Civil Case No. IPR2017-01408, Webster Dictionary p. 2211 (Merriam-Webster, Inc. 1961, 2002) (EX. 3001).
Nautilus, Inc. v. ICON Health & Fitness, Inc., Civil Case No. IPR2017-01363, Petitioner's Reply in Support of Petition for Inter Partes Review; filed Jun. 4, 2018; 18 pages (paper 21).

(56) References Cited

OTHER PUBLICATIONS

Nautilus, Inc. v. ICON Health & Fitness, Inc., Civil Case No. IPR2017-01363, Petitioner's Motion for Pro Hac Vice Admission, filed Jun. 6, 2018; 5 pages (paper 22).
Nautilus, Inc. v. ICON Health & Fitness, Inc., Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).
Nautilus, Inc. v. ICON Health & Fitness, Inc., Civil Case No. IPR2017-01363, Order granting Motion for Pro Hac Vice Admission—37 C.F.R. 42.10(c), filed Jun. 14, 2018; 4 pages (paper 23).
Nautilus, Inc. v. ICON Health & Fitness, Inc., Civil Case No. IPR2017-01363, Petitioner's Updated Mandatory Notices, filed Jun. 20, 2018; 4 pages (paper 24).
Nautilus, Inc. v. ICON Health & Fitness, Inc., Civil Case No. IPR2017-01363, Petitioner's Updated Power of Attorney, filed Jun. 20, 2018; 3 pages (paper 25).
Nautilus, Inc. v. ICON Health & Fitness, Inc., Civil Case No. IPR2017-01363, Petitioner's Request for Oral Argument, filed Jul. 25, 2018; 4 pages; (paper 26).
Nautilus, Inc. v. ICON Health & Fitness, Inc., Civil Case No. IPR2017-01363, Patent Owner's Request for Oral Argument, filed Jul. 25, 2018; 4 pages (paper 27).
Nautilus, Inc. v. ICON Health & Fitness, Inc., Civil Case No. IPR2017-01363, Order 37 C.F.R. 42.70, filed Aug. 14, 2018, 5 pages (paper 28).
Nautilus, Inc. v. ICON Health & Fitness, Inc., Civil Case No. IPR2017-01363, Current Exhibit List of Patent Owner, filed Aug. 24, 2018, 3 pages (paper 29).
Nautilus, Inc. v. ICON Health & Fitness, Inc., Civil Case No. IPR2017-01363, Order Conduct of Proceedings 37 C.F.R. 42.5, filed Aug. 24, 2018, 4 pages (paper 30).
Nautilus, Inc. v. ICON Health & Fitness, Inc., Civil Case No. IPR2017-01363, Petitioner's Updated Exhibit List, filed Aug. 24, 2018, 4 pages (paper 31).
Nautilus, Inc. v. ICON Health & Fitness, Inc., Civil Case No. IPR2017-01363; Petitioner's Oral Argument Demonstrative Exhibits, filed Aug. 24, 2018, 31 pages (exhibit 1012).
Nautilus, Inc. v. ICON Health & Fitness, Inc., Civil Case No. IPR2017-01363; Patent Owner Demonstrative Exhibits; filed Aug. 24, 2018, 10 pages (exhibit 2003).
Nautilus, Inc. v. ICON Health & Fitness, Inc., Civil Case No. IPR2017-01407, Petitioner's Motion for Pro Hac Vice Admission, filed Jun. 6, 2018, 5 pages (paper 21).
Nautilus, Inc. v. ICON Health & Fitness, Inc., Civil Case No. IPR2017-01407, Patent Owner's Objections to Evidence, filed Jun. 7, 2018, 5 pages (paper 22).
Nautilus, Inc. v. ICON Health & Fitness, Inc., Civil Case No. IPR2017-01407, Patent Owner's Notice of Deposition of Christopher Cox, filed Jun. 13, 2018, 3 pages (paper 23).
Nautilus, Inc. v. ICON Health & Fitness, Inc., Civil Case No. IPR2017-01407, Order—Granting Motion for Pro Hac Vice Admission, filed Jun. 14, 2018, 4 pages (paper 24).
Nautilus, Inc. v. ICON Health & Fitness, Inc., Civil Case No. IPR2017-01407, Petitioner's Updated Mandatory Notices, filed Jun. 20, 2018, 4 pages, (paper 25).
Nautilus, Inc. v. ICON Health & Fitness, Inc., Civil Case No. IPR2017-01407, Petitioner's Updated Power of Attorney, filed Jun. 20, 2018, 3 pages, (paper 26).
Nautilus, Inc. v. ICON Health & Fitness, Inc., Civil Case No. IPR2017-01407, Patent Owner's Reply to Petitioners Opposition to Motions to Amend, filed Jul. 5, 2018, 28 pages, (paper 27).
Nautilus, Inc. v. ICON Health & Fitness, Inc., Civil Case No. IPR2017-01407, Current Exhibit List for Patent Owner, filed Jul. 5, 2018, 4 pages, (paper 28).
Nautilus, Inc. v. ICON Health & Fitness, Inc., Civil Case No. IPR2017-01407, Patent Owners Updated Mandatory Notices, filed Jul. 5, 2018, 4 pages, (paper 29).
Nautilus, Inc. v. ICON Health & Fitness, Inc., Civil Case No. IPR2017-01407, Petitioner's Notice of Deposition Scott Ganaja, filed Jul. 11, 2018, 3 pages (paper 30).
Nautilus, Inc. v. ICON Health & Fitness, Inc., Civil Case No. IPR2017-01407, Joint Notice of Stipulation to Modify Scheduling Order, filed Jul. 12, 2018, 3 pages, (paper 31).
Nautilus, Inc. v. ICON Health & Fitness, Inc., Civil Case No. IPR2017-01407, Petitioner's Objections to Evidence, filed Jul. 12, 2018, 4 pages (paper 32).
Nautilus, Inc. v. ICON Health & Fitness, Inc., Civil Case No. IPR2017-01407, Petitioner's Amended Notice of Deposition Scott Ganaja, filed Jul. 12, 2018, 3 pages (paper 33).
Nautilus, Inc. v. ICON Health & Fitness, Inc., Civil Case No. IPR2017-01407, Order Conduct of Proceeding 37 C.F.R. 42.5, filed Jul. 20, 2018, 5 pages, (paper 34).
Nautilus, Inc. v. ICON Health & Fitness, Inc., Civil Case No. IPR2017-01407, Petitioner's Sur-Reply ISO Opposition to Motions to Amend, filed Aug. 1, 2018, 19 pages, (paper 35).
Nautilus, Inc. v. ICON Health & Fitness, Inc., Civil Case No. IPR2017-01407, Joint Notice of Stipulation to Modify Scheduling Order, filed Aug. 3, 2018, 3 pages (paper 36).
Nautilus, Inc. v. ICON Health & Fitness, Inc., Civil Case No. IPR2017-01407, Order Conduct of the Proceeding, filed Aug. 7, 2018, 4 pages (paper 37).
Nautilus, Inc. v. ICON Health & Fitness, Inc., Civil Case No. IPR2017-01407, Patent Owner's Objections to Petitioners Sur Reply, filed Aug. 8, 2018, 5 pages (paper 38).
Nautilus, Inc. v. ICON Health & Fitness, Inc., Civil Case No. IPR2017-01407, Patent Owner's Request for Oral Argument, filed Aug. 10, 2018, 4 pages , (paper 39).
Nautilus, Inc. v. ICON Health & Fitness, Inc., Civil Case No. IPR2017-01407, Petitioner's Request for Oral Argument, filed Aug. 10, 2018, 4 pages, (paper 40).
Nautilus, Inc. v. ICON Health & Fitness, Inc., Civil Case No. IPR2017-01407, Patent Owner's Motion to Exclude Evidence, filed Aug. 10, 2018, 11 pages (paper 41).
Nautilus, Inc. v. ICON Health & Fitness, Inc., Civil Case No. IPR2017-01407, Order 37 C.F.R. 42.70, filed Aug. 14, 2018, 5 pages (paper 42).
Nautilus, Inc. v. ICON Health & Fitness, Inc., Civil Case No. IPR2017-01407, Petitioner's Opposition to Patent Owner's Motion to Exclude, filed Aug. 16, 2018, 18 pages (paper 44).
Nautilus, Inc. v. ICON Health & Fitness, Inc., Civil Case No. IPR2017-01407, Patent Owner's Reply in support of Motion to Exclude, filed Aug. 22, 2018, 8 pages, (paper 45).
Nautilus, Inc. v. ICON Health & Fitness, Inc., Civil Case No. IPR2017-01407, Current Exhibit List of Patent Owner, filed Aug. 24, 2018, 4 pages (paper 46).
Nautilus, Inc. v. ICON Health & Fitness, Inc., Civil Case No. IPR2017-01407, Order re PO Sur-Rebuttal at Hearing, filed Aug. 24, 2018, 4 pages (paper 47).
Nautilus, Inc. v. ICON Health & Fitness, Inc., Civil Case No. IPR2017-01407, Exhibit 1012—U.S. Pat. No. 8,585,561 (Watt), filed Jun. 4, 2018, 32 pages.
Nautilus, Inc. v. ICON Health & Fitness, Inc., Civil Case No. IPR2017-01407, Exhibit 1013—U.S. Pat. No. 9,044,635 (Lull), filed Jun. 4, 2018, 21 pages.
Nautilus, Inc. v. ICON Health & Fitness, Inc., Civil Case No. IPR2017-01407, Exhibit 1014—U.S. Pat. No. 7,740,563 (Dalebout), filed Jun. 4, 2018, 31 pages.
Nautilus, Inc. v. ICON Health & Fitness, Inc., Civil Case No. IPR2017-01407, Exhibit 1015—US20020055418A1 (Pyles), filed Jun. 4, 2018, 9 pages.
Nautilus, Inc. v. ICON Health & Fitness, Inc., Civil Case No. IPR2017-01407, Exhibit 1016—US20120258433A1 (Hope), filed Jun. 4, 2018, 51 pages.
Nautilus, Inc. v. ICON Health & Fitness, Inc., Civil Case No. IPR2017-01407, Exhibit 1017—U.S. Pat. No. 7,771,320 (Riley), filed Jun. 4, 2018, 44 pages.
Nautilus, Inc. v. ICON Health & Fitness, Inc., Civil Case No. IPR2017-01407, Exhibit 1018—Declaration of Christopher Cox in Support of Petitioners Oppositions to Patent Owners Motions to Amend, filed Jun. 4, 2018, 739 pages.

(56) References Cited

OTHER PUBLICATIONS

Nautilus, Inc. v. ICON Health & Fitness, Inc., Civil Case No. IPR2017-01407, Exhibit 1019—Affidavit of Lane M. Polozola in Support of Petitioners Motion for Pro Hac Vice Admission, filed Jun. 6, 2018, 4 pages.
Nautilus, Inc. v. ICON Health & Fitness, Inc., Civil Case No. IPR2017-01407, Exhibit 1020—S. Ganaja Depo Transcript, filed Aug. 1, 2018, 58 pages.
Nautilus, Inc. v. ICON Health & Fitness, Inc., Civil Case No. IPR2017-01407, Exhibit 1021—Petitioner's Demonstrative Exhibits, filed Aug. 24, 2018, 92 pages.
Nautilus, Inc. v. ICON Health & Fitness, Inc., Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
Nautilus, Inc. v. ICON Health & Fitness, Inc., Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
Nautilus, Inc. v. ICON Health & Fitness, Inc., Civil Case No. IPR2017-01407, Exhibit 2013—Cox, Christopher Depo Transcript Jun. 26, 2018, filed Jul. 5, 2018, 26 pages.
Nautilus, Inc. v. ICON Health & Fitness, Inc., Civil Case No. IPR2017-01407, Exhibit 2014—Patent Owner Demonstrative Exhibits, filed Aug. 24, 2018, 21 pages.
Nautilus, Inc. v. ICON Health & Fitness, Inc., Civil Case No. IPR2017-01408, Petitioner's Opposition to Patent Owner's Motion to Amend, filed Jun. 4, 2018, 44 pages (paper 21).
Nautilus, Inc. v. ICON Health & Fitness, Inc., Civil Case No. IPR2017-01408, Petitioners Motion for Pro Hac Vice Admission, filed Jun. 6, 2018, 5 pages (paper 22).
Nautilus, Inc. v. ICON Health & Fitness, Inc., Civil Case No. IPR2017-01408, Patent Owner's Objections to Evidence, filed Jun. 7, 2018, 5 pages (paper 23).
Nautilus, Inc. v. ICON Health & Fitness, Inc., Civil Case No. IPR2017-01408, Declaration R. Lee Rawls, Part 1, dated May 12, 2017, 447 pages, (paper 24).
Nautilus, Inc. v. ICON Health & Fitness, Inc., Civil Case No. IPR2017-01408, Declaration R. Lee Rawls, Part 2, dated May 12, 2017, 216 pages, (paper 24).
Nautilus, Inc. v. ICON Health & Fitness, Inc., Civil Case No. IPR2017-01408, Order granting Motion for Pro Hac Vice Admission, filed Jun. 14, 2018, 4 pages (paper 25).
Nautilus, Inc. v. ICON Health & Fitness, Inc., Civil Case No. IPR2017-01408, Petitioner's Updated Mandatory Notices, filed Jun. 20, 2018, 4 pages, (paper 26).
Nautilus, Inc. v. ICON Health & Fitness, Inc., Civil Case No. IPR2017-01408, Petitioner's Updated Power of Attorney, filed Jun. 20, 2018, 3 pages, (paper 27).
Nautilus, Inc. v. ICON Health & Fitness, Inc., Civil Case No. IPR2017-01408, Patent Owner's Reply to Opposition to Motions to Amend, filed Jul. 5, 2018, 28 pages, (paper 28).
Nautilus, Inc. v. ICON Health & Fitness, Inc., Civil Case No. IPR2017-01408, Current Exhibit List of Patent Owner, filed Jul. 5, 2018, 4 pages, (paper 29).
Nautilus, Inc. v. ICON Health & Fitness, Inc., Civil Case No. IPR2017-01408, Patent Owner's Updated Mandatory Notices, filed Jul. 5, 2018, 4 pages, (paper 30).
Nautilus, Inc. v. ICON Health & Fitness, Inc., Civil Case No. IPR2017-01408, Petitioner's Notice of Deposition of Scott Ganaja, filed Jul. 11, 2018, 3 pages (paper 31).
Nautilus, Inc. v. ICON Health & Fitness, Inc., Civil Case No. IPR2017-01408, Joint Notice of Stipulation to Modify Scheduling Order, filed Jul. 12, 2018, 3 pages (paper 32).
Nautilus, Inc. v. ICON Health & Fitness, Inc., Civil Case No. IPR2017-01408, Petitioner's Objections to Patent Owner's Evidence, filed Jul. 12, 2018, 4 pages, (paper 33).
Nautilus, Inc. v. ICON Health & Fitness, Inc., Civil Case No. IPR2017-01408, Petitioner's Amended Notice of Deposition of Scott Ganaja, filed Jul. 12, 2018, 3 pages, (paper 34).
Nautilus, Inc. v. ICON Health & Fitness, Inc., Civil Case No. IPR2017-01408, Order—Conduct of the Proceeding, 37 C.F.R. 42.5, filed Jul. 20, 2018, 5 pages (paper 35).
Nautilus, Inc. v. ICON Health & Fitness, Inc., Civil Case No. IPR2017-01408, Petitioner's Sur-Reply in Support of Opposition to Patent Owners Motions to Amend, filed Aug. 1, 2018, 19 pages, (paper 36).
Nautilus, Inc. v. ICON Health & Fitness, Inc., Civil Case No. IPR2017-01408, Joint Notice of Stipulation to Modify Scheduling Order, filed Aug. 3, 2018, 3 pages (paper 37).
Nautilus, Inc. v. ICON Health & Fitness, Inc., Civil Case No. IPR2017-01408, Order—Conduct of the Proceeding, 37 C.F.R. 42.5, filed Aug. 7, 2018, 4 pages (paper 38).
Nautilus, Inc. v. ICON Health & Fitness, Inc., Civil Case No. IPR2017-01408, Patent Owner's Objections to Petitioners Sur Reply, filed Aug. 2, 2018, 5 pages, (paper 39).
Nautilus, Inc. v. ICON Health & Fitness, Inc., Civil Case No. IPR2017-01408, Patent Owner's Request for Oral Argument, filed Aug. 10, 2018, 4 pages, (paper 40).
Nautilus, Inc. v. ICON Health & Fitness, Inc., Civil Case No. IPR2017-01408, Petitioner's Request for Oral Argument, filed Aug. 10, 2018, 4 pages, (paper 41).
Nautilus, Inc. v. ICON Health & Fitness, Inc., Civil Case No. IPR2017-01408, Patent Owner's Motion to Exclude Evidence, filed Aug. 10, 2018, 11 pages (paper 42).
Nautilus, Inc. v. ICON Health & Fitness, Inc., Civil Case No. IPR2017-01408, Order—Oral Hearing 37 C.F.R. 42.70, filed Aug. 14, 2018, 5 pages (paper 43).
Nautilus, Inc. v. ICON Health & Fitness, Inc., Civil Case No. IPR2017-01408, Petitioner's Opposition to Patent Owner's Motion to Exclude Evidence, filed Aug. 16, 2018, 18 pages (paper 44).
Nautilus, Inc. v. ICON Health & Fitness, Inc., Civil Case No. IPR2017-01408, Patent Owners Reply in Support of its Motion to Exclude, filed Aug. 22, 2018, 8 pages, (paper 46).
Nautilus, Inc. v. ICON Health & Fitness, Inc., Civil Case No. IPR2017-01408, Current Exhibit List of Patent Owner, filed Aug. 24, 2018, 4 pages (paper 47).
Nautilus, Inc. v. ICON Health & Fitness, Inc., Civil Case No. IPR2017-01408, Order Conduct of the Proceedings—37 C.F.R. 42.5, filed Aug. 24, 2018, 4 pages, (paper 48).
Nautilus, Inc. v. ICON Health & Fitness, Inc., Civil Case No. IPR2017-01408, Petitioner's Updated Exhibit List, filed Aug. 24, 2018, 5 pages, (paper 49).
Nautilus, Inc. v. ICON Health & Fitness, Inc., Civil Case No. IPR2017-01408, Exhibit 1012—U.S. Pat. No. 8,585,561 (Watt), filed Jun. 4, 2018, 32 pages.
Nautilus, Inc. v. ICON Health & Fitness, Inc., Civil Case No. IPR2017-01408, Exhibit 1013—U.S. Pat. No. 9,044,635 (Lull), filed Jun. 4, 2018, 21 pages.
Nautilus, Inc. v. ICON Health & Fitness, Inc., Civil Case No. IPR2017-01408, Exhibit 1014—U.S. Pat. No. 7,740,563 (Dalebout), filed Jun. 4, 2018, 31 pages.
Nautilus, Inc. v. ICON Health & Fitness, Inc., Civil Case No. IPR2017-01408, Exhibit 1015—US20020055418A1 (Pyles), filed Jun. 4, 2018, 9 pages.
Nautilus, Inc. v. ICON Health & Fitness, Inc., Civil Case No. IPR2017-01408, Exhibit 1016—US20120258433A1 (Hope), filed Jun. 4, 2018, 51 pages.
Nautilus, Inc. v. ICON Health & Fitness, Inc., Civil Case No. IPR2017-01408, Exhibit 1017—U.S. Pat. No. 7,771,320 (Riley), filed Jun. 4, 2018, 44 pages.
Nautilus, Inc. v. ICON Health & Fitness, Inc., Civil Case No. IPR2017-01408, Exhibit 1018—Declaration of Christopher Cox in Support of Petitioners Oppositions to Patent Owners Motions to Amend, filed Jun. 4, 2018, 739 pages.
Nautilus, Inc. v. ICON Health & Fitness, Inc., Civil Case No. IPR2017-01408, Exhibit 1019—Affidavit of Lane M. Polozola in Support of Petitioners Motion for Pro Hac Vice Admission, filed Jun. 6, 2018, 4 pages.
Nautilus, Inc. v. ICON Health & Fitness, Inc., Civil Case No. IPR2017-01408, Exhibit 1020—Scott Ganaja Depo Transcript, filed Aug. 1, 2018, 58 pages.

(56) References Cited

OTHER PUBLICATIONS

Nautilus, Inc. v. ICON Health & Fitness, Inc., Civil Case No. IPR2017-01408, Exhibit 1021—Petitioner's Demonstrative Exhibits, filed Aug. 24, 2018, 92 pages.
Nautilus, Inc. v. ICON Health & Fitness, Inc., Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
Nautilus, Inc. v. ICON Health & Fitness, Inc., Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
Nautilus, Inc. v. ICON Health & Fitness, Inc., Civil Case No. IPR2017-01408, Exhibit 2013—Cox, Christopher Depo Transcript Jun. 26, 2018, filed Jul. 5, 2018, 26 pages.
Nautilus, Inc. v. ICON Health & Fitness, Inc., Civil Case No. IPR2017-01408, Exhibit 2014—Patent Owner's Demonstrative Exhibits, filed Aug. 24, 2018, 21 pages.
European Patent Office, Article 94(3) EPC Communication dated Jul. 10, 2018, issued in European Patent Application No. 14768130.8-1126, 3 pages.
United States Patent and Trademark Office; International Search Report and Written Opinion issued in application No. PCT/US2015/034665; dated Oct. 8, 2015 (14 pages).
Nautilus, Inc. v. ICON Health & Fitness, Inc., Civil Case No's. IPR2017-01363, IPR2017-01407, and IPR2017-01408 Record of Oral Hearing held Aug. 29, 2018; (paper 32) 104 pages.
Nautilus, Inc. v. ICON Health & Fitness, Inc., Civil Case No. IPR2017-01407—Petitioner's Updated Exhibit List, filed Aug. 24, 2018, (paper 48) 5 pages.
Nautilus, Inc. v. ICON Health & Fitness, Inc., Civil Case No. IPR2017-01363, Final Written Decision dated Nov. 28, 2018; (paper 33) 29 pages.
Nautilus, Inc. v. ICON Health & Fitness, Inc., Civil Case No's. IPR2017-01407, Final Written Decision dated Decembers, 2018; (paper 50) 81 pages.
Nautilus, Inc. v. ICON Health & Fitness, Inc., Civil Case Nos. IPR2017-01408, Final Written Decision dated Dec. 3, 2018; (paper 51) 82 pages.
U.S. Appl. No. 16/572,272; filed Sep. 16, 2019, titled "Cable Exercise Machine", (35 pages).
U.S. Appl. No. 62/310,467, filed Mar. 18, 2016, titled "Collapsible Strength Exercise Machine", 31 pages.
U.S. Appl. No. 62/429,977, filed Dec. 5, 2016, titled "Pull Cable Resistance Mechanism in a Treadmill", 37 pages.
U.S. Appl. No. 62/429,970, filed Dec. 5, 2016, titled "Tread Belt Locking Mechanism", 37 pages.
International Bureau of WIPO; International Preliminary Report on Patentability; Int'l App No. PCT/US2017/064523 dated Jun. 11, 2019; 7 pages.
International Bureau of WIPO; International Preliminary Report on Patentability; Int'l App No. PCT/US2017/064536 dated Jun. 11, 2019; 8 pages.
Chinese Second Office Action for Chinese Patent Application No. 201480003701.9 dated Nov. 21, 2016.
Chinese Third Office Action for Chinese Patent Application No. 201480003701.9 dated Nov. 24, 2017.
Chinese Office Action for Chinese Patent Application No. 201580033332 dated Feb. 28, 2018.
Chinese Second Office Action for Chinese Patent Application No. 201580033332 dated Nov. 15, 2018.
Nordic Track Fusion CST Series; website; located at: http://www/nordictrack.com/fusion-cst-series; accessed on Jan. 24, 2018; 11 pages.
U.S. Appl. No. 62/804,146, filed Feb. 11, 2019, titled Cable and Power Rack Exercise Machine, 49 pages.
U.S. Appl. No. 16/780,765, filed Feb. 3, 2020, titled Cable and Power Rack Exercise Machine, 48 pages.
U.S. Appl. No. 16/787,850, filed Feb. 11, 2020, titled "Exercise Machine", 40 pages.
International Patent Application No. PCT/US20/17710, filed Feb. 11, 2020, titled "Exercise Machine", 41 pages.
First Office Action and Search Report with English translation issued in Taiwan application 106135830 dated Jun. 15, 2018.
U.S. Appl. No. 16/742,762, filed Jan. 14, 2020, titled Controlling an Exercise Machine Using a Video Workout Program, 146 pages.
U.S. Appl. No. 16/750,925, filed Jan. 2, 2020, titled Systems and Methods for an Interactive Pedaled Exercise Device, 54 pages.
U.S. Appl. No. 62/914,007, filed Oct. 11, 2019, titled Modular Exercise Device, 128 pages.
U.S. Appl. No. 62/934,291, filed Nov. 12, 2019, titled Exercise Storage System, 41 pages.
U.S. Appl. No. 62/934,297, filed Nov. 12, 2019, titled Exercise Storage System, 44 pages.
Extended European Search Report for European Application No. 17879180.2, dated Jun. 9, 2020, 8 pages.
Chinese First Office Action for Application No. 201780074846.1 dated May 9, 2020.
International Search Report and Written Opinion dated Aug. 20, 2020 issued in International Application No. PCT/US20/17710, 10 pages.
European Extended Search Report dated Dec. 20, 2019 issued in Application No. 19205866.7.

CABLE EXERCISE MACHINE

RELATED APPLICATIONS

This application is a continuation of U.S. patent application Ser. No. 16/258,356 filed Jan. 25, 2019, now U.S. Pat. No. 10,758,767, which is a continuation of U.S. patent application Ser. No. 15/976,496 filed May 10, 2018, now U.S. Pat. No. 10,188,890, which is a continuation of U.S. patent application Ser. No. 15/696,841 filed Sep. 6, 2017, now U.S. Pat. No. 9,968,816, which is a continuation of U.S. patent application Ser. No. 15/226,703 filed Aug. 2, 2016, now U.S. Pat. No. 9,757,605, which is a continuation of U.S. patent application Ser. No. 14/582,493 filed Dec. 24, 2014, now U.S. Pat. No. 9,403,047, which claims priority to provisional Patent Application No. 61/920,834 filed Dec. 26, 2013. Each of these applications is herein incorporated by reference in its entirety.

BACKGROUND

While there are numerous exercise activities that one may participate in, exercise may be broadly classified into categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. A cable machine is a popular piece of exercise equipment for building those muscle groups that produce pulling motions. A cable machine often includes a cable with a handle connected to a first end and a resistance mechanism connected to a second end. Generally, the resistance mechanism is connected to a selectable set of weights. A midsection of the cable is supported with at least one pulley. To move the cable, a user pulls on the handle with a force sufficient to overcome the force of the resistance mechanism. As the cable moves, the pulley or pulleys direct the movement of the cable and carry a portion of the resistance mechanism's load.

One type of cable exercise machine is disclosed in WIPO Patent Publication No. WO/2007/015096 issued to Andrew Loach. In this reference, an exercise apparatus allows the user to perform a variety of aerobic and strength training exercises. A user input means allows the user to apply torque to an input shaft of a resistance unit. A control means adjusts the resistance provided by a resistance means coupled to the input shaft according to the output of a number of sensors. In a preferred embodiment, the resistance unit is able to simulate at the input shaft the dynamic response of a damped flywheel or the dynamic response of an object driven through a viscous medium, or to maintain the resistance at a constant level that is set by the user. The resistance unit includes a battery or an electric generator device and can be operated without connection to an external power source. Other types of cable exercise machines are described in U.S. Patent Publication Nos. 2012/0065034 issued to Andrew Loach and 2006/0148622 issued to Ping Chen. All of these references are herein incorporated by reference for all that they disclose.

SUMMARY

In one aspect of the invention, a cable exercise machine includes a first pull cable and a second pull cable incorporated into a frame.

In one aspect of the invention, the cable exercise machine may further include that each of the first pull cable and the second pull cable are linked to at least one resistance mechanism.

In one aspect of the invention, the at least one resistance mechanism comprises a flywheel and a magnetic unit arranged to resist movement of the flywheel.

In one aspect of the invention, the cable exercise machine may further include a sensor arranged to collect information about a position of the flywheel.

In one aspect of the invention, the cable exercise machine may further include a counter in communication with the sensor and arranged to track a number of rotations of the flywheel.

In one aspect of the invention, the counter is arranged to provide the number as input to an energy tracker.

In one aspect of the invention, the energy tracker is arranged to receive as input a level of magnetic resistance exerted on the flywheel with the magnetic unit.

In one aspect of the invention, the frame is a tower.

In one aspect of the invention, the cable exercise machine may further include that a third pull cable and a fourth pull cable are also incorporated into the tower.

In one aspect of the invention, the cable exercise machine may further include that a first handle end of the first pull cable is routed to an upper right location of the tower.

In one aspect of the invention, the cable exercise machine may further include that a second handle end of the second pull cable is routed to an upper left location of the tower.

In one aspect of the invention, the cable exercise machine may further include that a third handle end of the third pull cable is routed to a lower right location of the tower.

In one aspect of the invention, the cable exercise machine may further include that a fourth handle end of the fourth pull cable is routed to a lower left location of the tower.

In one aspect of the invention, the flywheel is positioned between the upper right location, the upper left location, the lower right location, and the lower left location.

In one aspect of the invention, the cable exercise machine may further include at least two of the first pull cable, the second pull cable, the third pull cable and the fourth pull cable are connected to the same resistance mechanism.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in just a single direction while at least one of the multiple spools are arranged to rotate in the single direction and an opposite direction.

In one aspect of the invention, the spools are linked to at least one counterweight.

In one aspect of the invention, an cable exercise machine may include a first pull cable, a second pull cable, a third pull cable, and a fourth pull cable incorporated into a tower.

In one aspect of the invention, the cable exercise machine may further include that a first handle end of the first pull cable is routed to an upper right location of the tower, a second handle end of the second pull cable is routed to an upper left location of the tower, a third handle end of the third pull cable is routed to a lower right location of the tower, and a fourth handle end of the fourth pull cable is routed to a lower left location of the tower.

In one aspect of the invention, each of the first pull cable, the second pull cable, the third pull cable, and the fourth pull cable are connected to a resistance mechanism.

In one aspect of the invention, the resistance mechanism comprises a flywheel and a magnetic unit arranged to resist movement of the flywheel.

In one aspect of the invention, the flywheel is positioned between the upper right location, the upper left location, the lower right location, and the lower left location.

In one aspect of the invention, the cable exercise machine may further include a sensor arranged to collect information about a position of the flywheel.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in only a single direction while at least one of the multiple spools is arranged to rotate in the single direction and an opposite direction.

In one aspect of the invention, the spools are linked to at least one counterweight.

In one aspect of the invention, the cable exercise machine may further include a counter in communication with the sensor and arranged to track a number of rotations of the flywheel.

In one aspect of the invention, the counter is arranged to provide the number as input to an energy tracker.

In one aspect of the invention, a cable exercise machine may include a first pull cable, a second pull cable, a third pull cable, and a fourth pull cable incorporated into a tower.

In one aspect of the invention, the cable exercise machine may further include that a first handle end of the first pull cable is routed to an upper right location of the tower, a second handle end of the second pull cable is routed to an upper left location of the tower, a third handle end of the third pull cable is routed to a lower right location of the tower, and a fourth handle end of the fourth pull cable is routed to a lower left location of the tower.

In one aspect of the invention, each of the first pull cable, the second pull cable, the third pull cable, and the fourth pull cable are connected to a resistance mechanism.

In one aspect of the invention, the resistance mechanism comprises a flywheel and a magnetic unit arranged to resist movement of the flywheel.

In one aspect of the invention, the flywheel is positioned between the upper right location, the upper left location, the lower right location, and the lower left location.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in only a single direction while at least one of the multiple spools is arranged to rotate in the single direction and an opposite direction.

In one aspect of the invention, the spools are linked to at least one counterweight.

In one aspect of the invention, the cable exercise machine may further include a sensor is arranged to collect information about a position of the flywheel.

In one aspect of the invention, the cable exercise machine may further include a counter is in communication with the sensor and arranged to track a number of rotations of the flywheel.

In one aspect of the invention, the counter is arranged to provide the number as input to an energy tracker.

In one aspect of the invention, the energy tracker is arranged to receive as input a level of magnetic resistance exerted on the flywheel with the magnetic unit.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
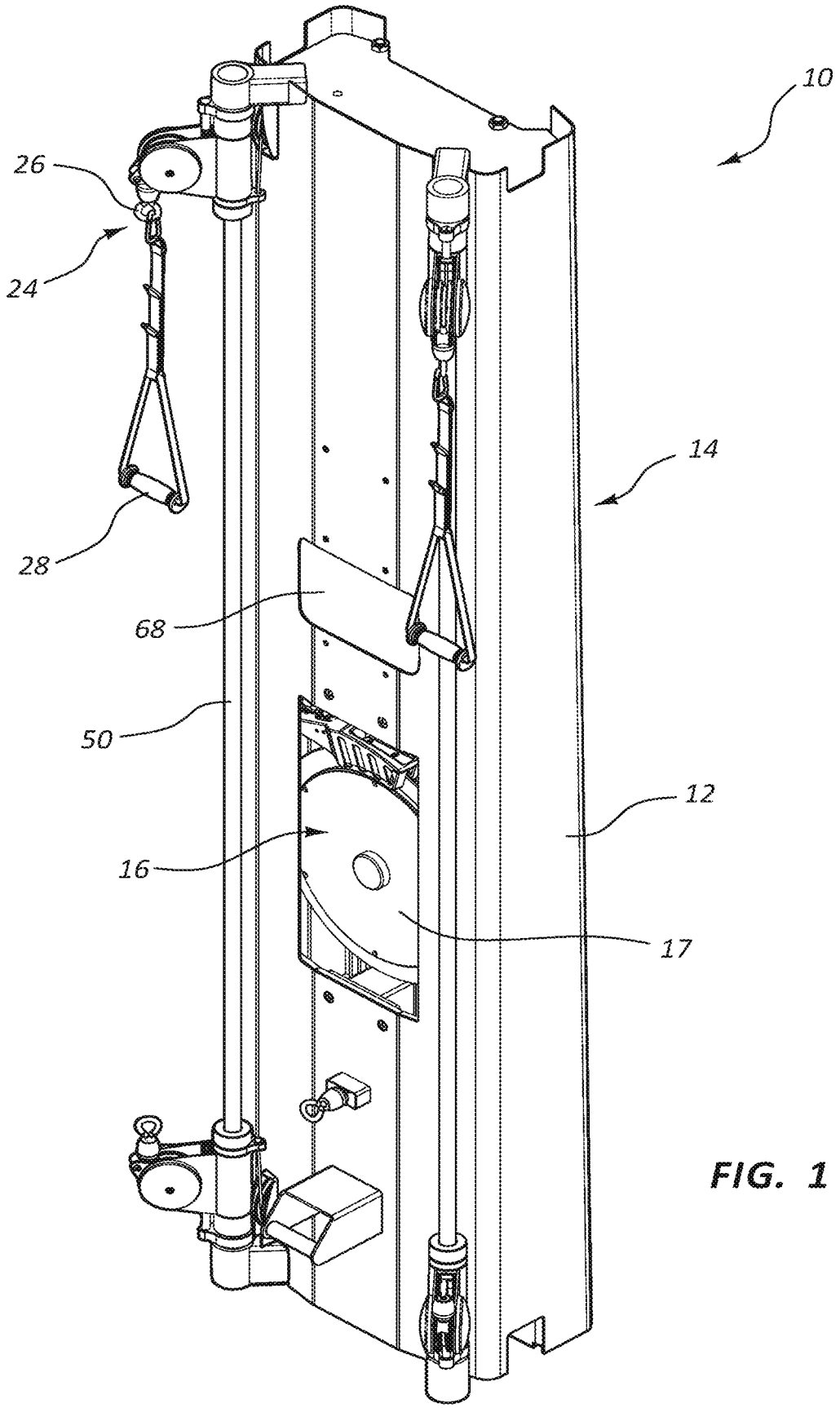
FIG. 1 illustrates a front perspective view of an example of a cable exercise machine in accordance with the present disclosure.
Figure 2:
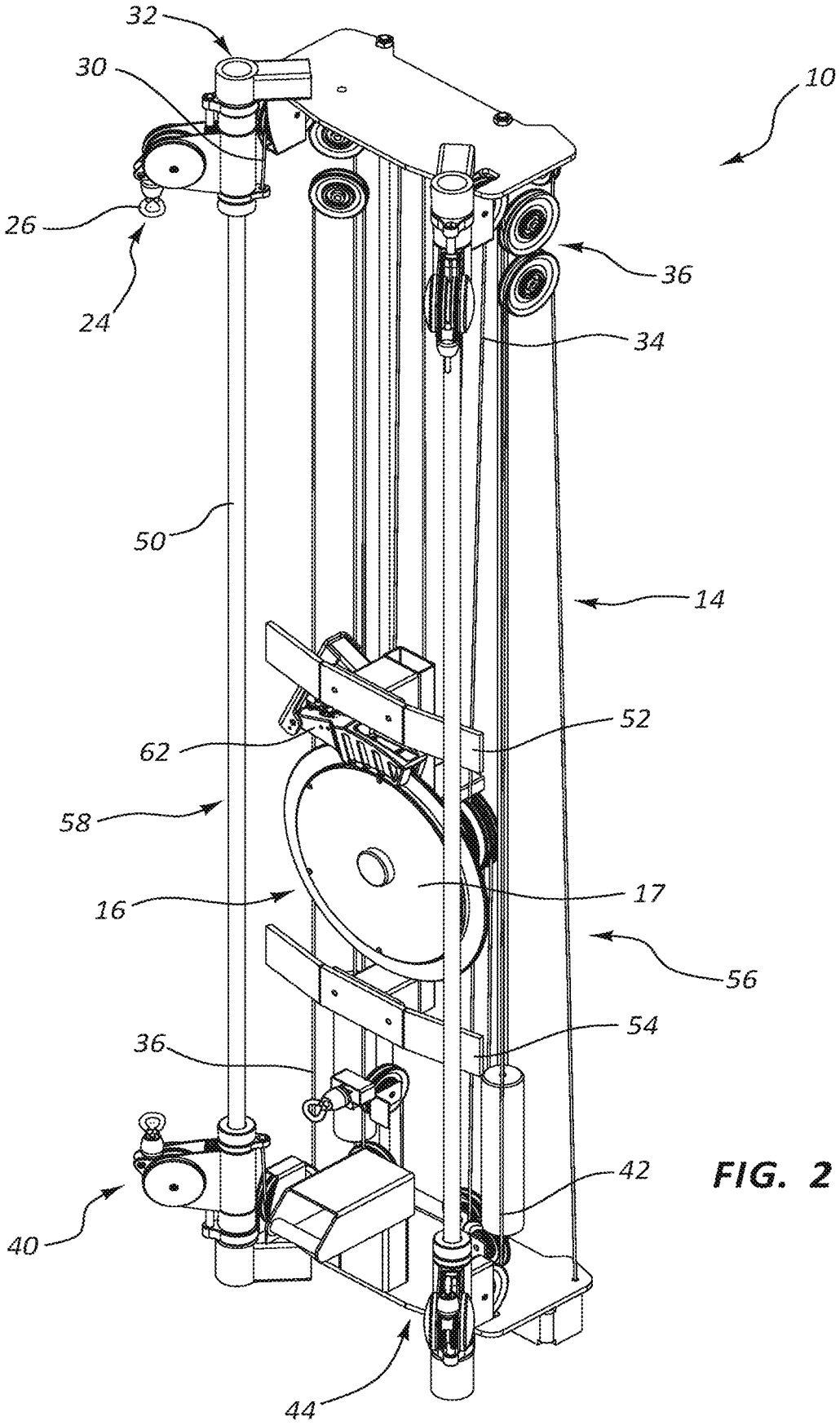
FIG. 2 illustrates a front perspective view of the cable exercise machine of FIG. 1 with an outside cover removed.
Figure 3:
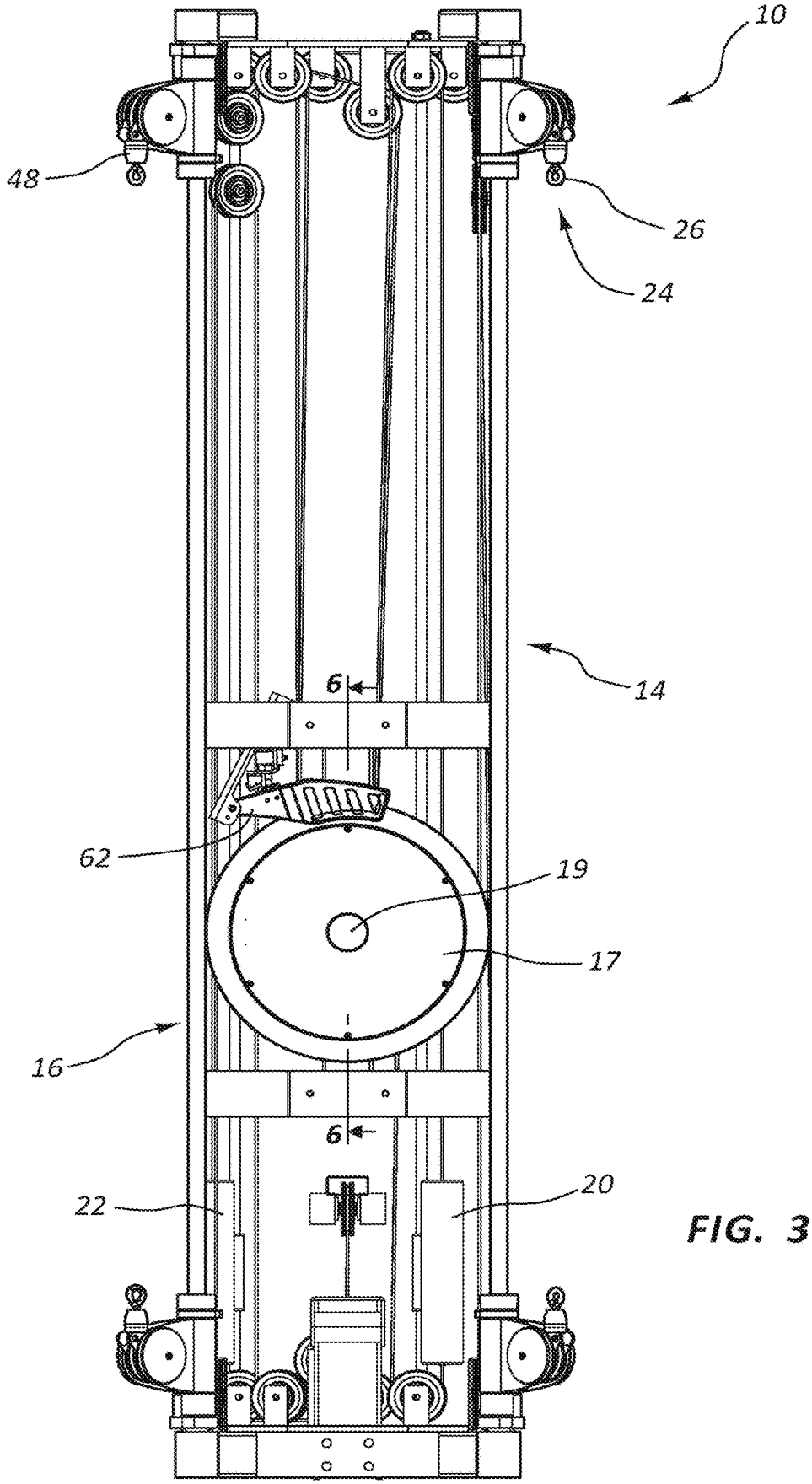
FIG. 3 illustrates a front view of the cable exercise machine of FIG. 1 with an outside cover removed.
Figure 4:
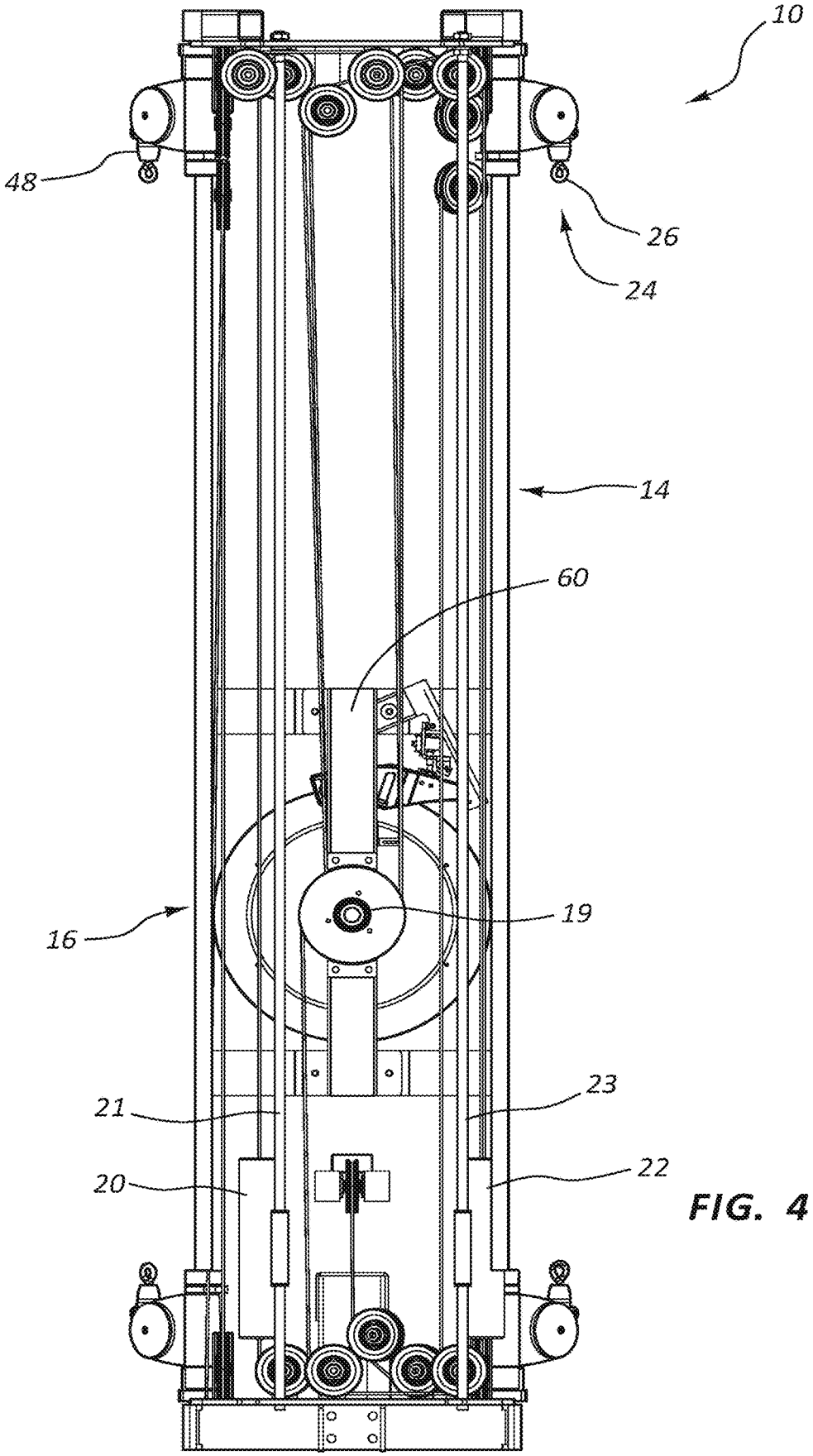
FIG. 4 illustrates a back view of the cable exercise machine of FIG. 1 with an outside cover removed.
Figure 5:
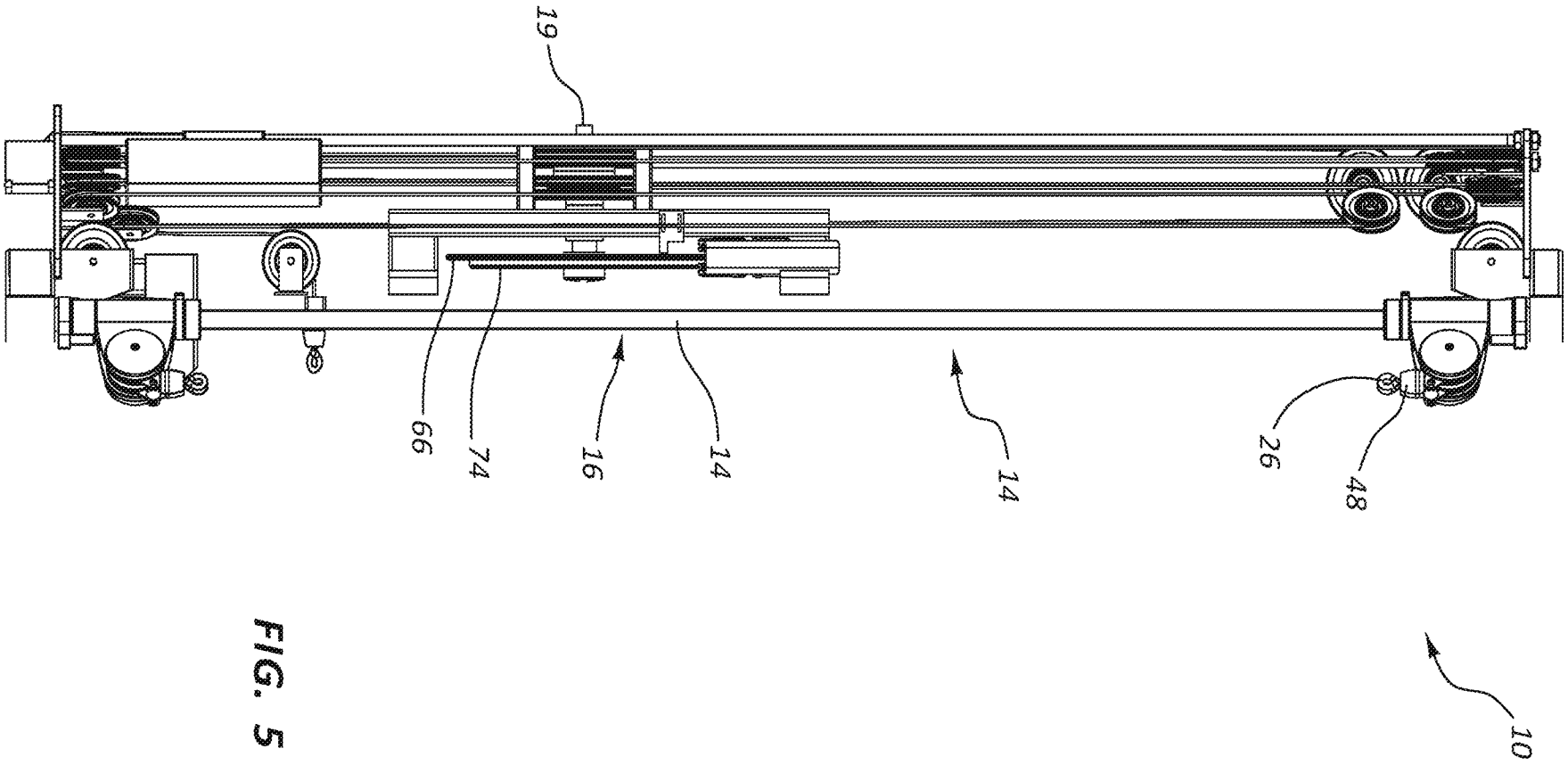
FIG. 5 illustrates a side view of the cable exercise machine of FIG. 1 with an outside cover removed.

Those who exercise often desire to know the amount of calories that they burn during their workouts. This information allows them to track their progress and achieve health related goals. Calories are burned during anaerobic exercises, such as those types of exercises that are performed on a cable exercise machine. The amount of calories that are burned using a cable exercise machine depends on the number of repetitions that the cable is pulled, the distance that the cable is moved during each pull, and the amount of resistance associated with each pull.

Generally, cable exercise machines provide resistance to the movement of the cable with a set of weighted plates.

Often, these weighted plates are arranged in a stack with an ability to selectively connect a subset of the weighted plates to an attachment of the cable. This can be done by inserting a removable pin within a plate slot of at least one of the weighted plates such that the pin is also inserted into an attachment slot of the cable. With this arrangement, when the user pulls the cable, the weighted plate will move with the cable. Also, any plates stacked over the moving plate will move with the cable as well. However, this type of cable exercise machine does not include a mechanism that assists the user in tracking the amount of calories burned during the workout.

The principles described in the present disclosure include a cable exercise machine that incorporates a sensor that tracks the position of a flywheel. The flywheel is incorporated into a magnetic resistance mechanism that applies a load of resistance to the movement of the pull cable. As the flywheel rotates, the sensor tracks the rotation of the flywheel. In some embodiments, the sensor causes a counter to be incremented up one for each rotation of the flywheel. In other embodiments, the sensor can track partial revolutions of the flywheel.

The level of resistance applied by the magnetic resistance mechanism can be controlled electronically. For example, an electrical input into an electromagnetic unit can produce an output of resistance that can resist the movement of the cable. In other examples, an adjustable distance between a magnetic unit and the flywheel can also change the amount of resistance that is applied to the movement of the cable. The inputs or outputs of these and other types of adjustable resistance mechanisms can be tracked and stored.

The tracked level of resistance can be sent to an energy tracker. Also, the sensor that tracks the position of the flywheel can also send position information to the energy tracker as an input. The energy tracker can determine the amount of calories (or other energy units) burned during each pull and/or collectively during the course of the entire workout based on the inputs about the flywheel position and the resistance level.

The principles described herein also include a unique example of a flywheel arrangement where a single flywheel is arranged to resist the movement of four different resistance cables. In some examples, the flywheel is attached to a central shaft with multiple spools coaxially mounted around the central shaft. The spools can contain attachments to at least one of the cables. As one of the pull cables is moved in a first direction, the spools are rotated in a first direction. The torque generated by rotating the spools is transferred to the flywheel, and the flywheel will rotate in the first direction with the spools. However, when the pull cable is returned, the force that caused the spools to rotate in the first direction ceases. At least one counterweight is connected to the flywheel through a counterweight cable. In the absence of the force imposed on the pull cable, the counterweights cause the spools to rotate back in the opposite direction to their original orientation before the pull cable force was imposed. However, the arrangement between the flywheel, shaft, and spools does not transfer the torque generated in the second direction to the flywheel. As a result, the orientation of the flywheel does not change as the counterweights pull the spools back. As the spools return to their original orientation in the opposite direction, the pull cables are rewound around the spools, which returns the handles connected to the pull cable back to their original locations as well.

Thus, in this example, the flywheel rotates in a single direction regardless of the direction that the pull cable is moving. Further, in this example, the flywheel is just rotating when a pull force is exerted by the user. Thus, the position of the flywheel represents just work done as part of the workout. In other words, the return movement of the cable does not affect the calorie count. Further, the calorie counting calculations of the cable exercise machine are simplified because the sensor is insulated from at least the return forces that may skew the calorie counting calculations. Consequently, the tracked calories represent just those calories that are consumed during the course of the workout.

With reference to this specification, terms such as "upper," "lower," and similar terms that are used with reference to components of the cable exercise machine are intended to describe relative relationships between the components being described. Such terms generally depict the relationship between such components when the cable exercise machine is standing in the intended upright position for proper use. For example, the term "lower" may refer to those components of the cable exercise machine that are located relatively closer to the base of the cable exercise machine than another component when the cable exercise machine is in the upright position. Likewise, the term "upper" may refer to those components of the cable exercise machine that are located relatively farther away from the base of the cable exercise machine when in the upright position. Such components that are described with "upper," "lower," or similar terms do not lose their relative relationships just because the cable exercise machine is temporarily on one of its sides for shipping, storage, or during manufacturing.

Particularly, with reference to the figures, FIGS. 1-5 depict a cable exercise machine 10. FIG. 1 depicts the cable exercise machine 10 with an outer covering 12 about a tower 14 that supports the cables while FIGS. 2-5 depict different views of the cable exercise machine 10 without the outer covering 12. In the example of FIGS. 1-5, a resistance mechanism, such as a flywheel assembly 16, is positioned in the middle of the tower 14. The flywheel assembly 16 includes a flywheel 17, a spool subassembly 18, and a central shaft 19. The flywheel assembly 16 is connected to multiple cables through a spool subassembly 18. The cables are routed through multiple locations within the tower 14 with an arrangement of pulleys that direct the movement of the cables, a first counterweight 20, a second counterweight 22, and the flywheel assembly 16. The first and second counterweights 20, 22 are attached to a first counterweight guide 21 and a second counterweight guide 23 respectively. These guides 21, 23 guide the movement of the counterweights 20, 22 as they move with the rotation of the spool subassembly 18.

At least some of the cables have a handle end 24 that is equipped with a handle connector 26 that is configured to secure a handle 28 for use in pulling the cables. The pulleys route the handle ends 24 of a first cable 30 to an upper right location 32 of the tower 14, a second cable 34 to an upper left location 36 of the tower 14, a third cable 38 to a lower right location 40 of the tower 14, and a fourth cable 42 to a lower left location 44 of the tower 14. Each of these cables 30, 34, 38, 42 may be pulled to rotate the flywheel 17.

The handle connectors 26 may be any appropriate type of connector for connecting a handle 28 to a cable. In some examples, at least one of the handle connectors 26 includes a loop to which a handle 28 can be connected. Such a loop may be made of a metal, rope, strap, another type of material, or combinations thereof. In some examples, the loop is spring loaded. In yet other examples, a loop is formed out of the cable material which serves as the handle 28. The handle 28 may be a replaceable handle so that the user can change the type of grip or move the handle 28 to a different handle connector 26.

The user can pull any combination of the cables 30, 34, 38, 42 as desired. For example, the user may use the first and second cables 30, 34 as a pair for exercises that involve muscle groups that produce downward motions. In other examples, the user may use the third and fourth cables 38, 42 as a pair for exercises that involve muscle groups that produce upwards motions. Further, the user may use the first and third cables 30, 38 as a pair. Likewise, the user may use the second and fourth cables 34, 42 as a pair. In general, the user may combine any two of the cables to use as a pair to execute a workout as desired. Also, the user may use just a single cable as desired to execute a workout.

In some embodiments, a stopper 48 is attached to the handle ends 24 of the cables 30, 34, 38, 42. The stopper 48 can include a large enough cross sectional thickness to stop the handle end 24 from being pulled into a pulley, an opening in the outer covering, or another feature of the cable exercise machine 10 that directs the movement of the cables.

Additionally, the precise location to where the cables 30, 34, 38, 42 are routed may be adjusted. For example, a guide bar 50 may be positioned on the cable exercise machine 10 that allows a pulley supporting the handle end 24 to move along the guide bar's length. Such adjustments may be made to customize the workout for the individual user's height and/or desired target muscle group.

Within the tower 14, the pull cables 30, 34, 38, 42 may be routed in any appropriate manner such that a pull force on one of the pull cables 30, 34, 38, 42 causes the rotation of the flywheel 17. For example, each of the pull cables 30, 34, 38, 42 may have an end attached directly to the spool subassembly 18. In other examples, each of the pull cables 30, 34, 38, 42 may have an end attached directly to an intermediate component that attaches to the spool subassembly 18. The movement of the pull cables 30, 34, 38, 42 in a first pulling direction may cause the spool subassembly 18 to rotate in a first direction about the central shaft 19. Further, counterweights 20, 22 may be in communication with the spool subassembly 18 and arranged to rotate the spool subassembly 18 in a second returning direction. Further, the pull cables 30, 34, 38, 42 may be routed with a single pulley or with multiple pulleys. In some examples, multiple pulleys are used to distribute the load to more than one location on the tower to provide support for the forces generated by a user pulling the pull cables 30, 34, 38, 42 against a high resistance. Further, at least one of the pulleys incorporated within the tower may be a tensioner pulley that is intended to reduce the slack in the cables so that the resistance felt by the user is consistent throughout the pull.

A first cross bar 52 and a second cross bar 54 may collectively span from a first side 56 to a second side 58 of the tower 14. The cross bars 52, 54 collectively support an assembly member 60 that is oriented in a transverse orientation to the cross bars 52, 54. The central shaft 19 is inserted into an opening of the assembly member 60 and supports the flywheel assembly 16.

The flywheel assembly 16 includes an arm 62 that is pivotally coupled to a fixture 64 connected to the first cross bar 52. The arm 62 contains at least one magnetic unit 63 arranged to provide a desired magnetic flux. As the arm 62 is rotated to or away from the proximity of the flywheel 17, the magnetic flux through which the flywheel 17 rotates changes, thereby altering the amount of rotational resistance experienced by the flywheel 17.

The flywheel 17 may be constructed of multiple parts. For example, the flywheel 17 may include a magnetically conductive rim 66. In other embodiments, the flywheel 17 includes another type of magnetically conductive component that interacts with the magnetic flux imparted by the arm 62. As the magnetic flux increases, more energy is required to rotate the flywheel 17. Thus, a user must impart a greater amount of energy as he or she pulls on the pull cable to rotate the flywheel 17. As a result of the increased resistance, the user will consume more calories. Likewise, as the magnetic flux decreases, less energy is required to rotate the flywheel 17. Thus, a user can impart a lower amount of energy as he or she pulls on the pull cable to rotate the flywheel 17.

While this example has been described with specific reference to an arm 62 producing a magnetic flux that pivots to and away from the flywheel 17 to achieve a desired amount of resistance to rotation of the flywheel 17, any appropriate mechanism for applying a resistance to the rotation of the flywheel 17 may be used in accordance with the principles described herein. For example, the arm 62 may remain at a fixed distance from the flywheel 17. In such an example, the magnetic flux may be altered by providing a greater electrical input to achieve a greater magnetic output. Further, in lieu of pivoting the arm 62 to and away from the flywheel 17, a magnetic unit 63 may be moved towards or away from the flywheel 17 with a linear actuator or another type of actuator.

The cable exercise machine 10 may further include a control panel 68 which may be incorporated into the outer covering 12 or some other convenient location. The control panel 68 may include various input devices (e.g., buttons, switches, dials, etc.) and output devices (e.g., LED lights, displays, alarms, etc.). The control panel 68 may further include connections for communication with other devices. Such input devices may be used to instruct the flywheel assembly to change a level of magnetic resistance, track calories, set a timer, play music, play an audiovisual program, provide other forms of entertainment, execute a pre-programmed workout, perform another type of task, or combinations thereof. A display can indicate the feedback to the user about his or her performance, the resistance level at which the resistance mechanism is set, the number of calories consumed during the workout, other types of information, or combinations thereof.

Figure 6:
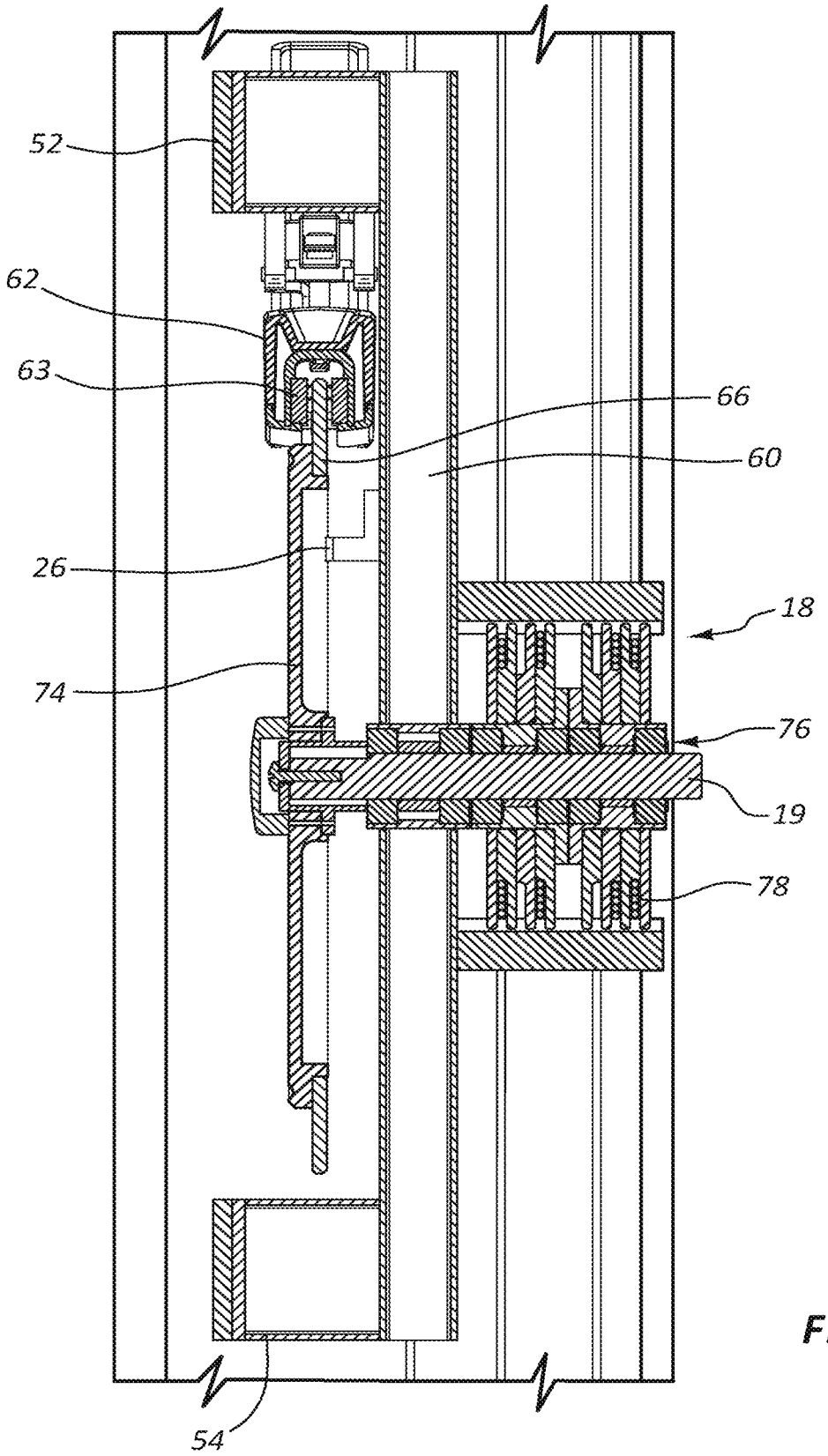
FIG. 6 illustrates a cross sectional view of a resistance mechanism of the cable exercise machine of FIG. 1.

FIG. 6 illustrates a cross sectional view of a resistance mechanism of the cable exercise machine of FIG. 1. In this example, the central shaft 19 is rigidly connected to a body 74 of the flywheel 17. A bearing subassembly 76 is disposed around the central shaft 19 and is positioned to transfer a rotational load imparted in a first direction to the flywheel 17. Concentric to the central shaft 19 and the bearing subassembly 76 is the spool subassembly 18 which is connected to at least one of the pull cables 30, 34, 38, 42.

In a retracted position, a portion of a pull cable connected to the spool subassembly 18 is wound in slots 78 formed in the spool subassembly 18. As the pull cable is pulled by the user during a workout, the pull cable exerts a force tangential in the first direction to the spool subassembly 18 and rotates the spool subassembly 18 in the first direction as the pull cable unwinds. In some examples, a counterweight cable that is also connected to the spool subassembly 18 winds up in the slots 78 of the spool subassembly 18. This motion shortens the available amount of the counterweight cable and causes at least one of the counterweights 20, 22 to be raised to a higher elevation. When the force on the pull cable ceases, the gravity on the counterweight pulls the counterweight back to its original position, which imposes another tangential force in a second direction on the spool subassembly 18 causing it to unwind the counterweight cable in the second direction. The unwinding motion of the counterweight cable causes the pull cable to rewind back into the slots 78 of the spool subassembly 18. This motion pulls the pull cable back into the tower 14 until the stoppers 48 attached to the handle ends 24 of the pull cables prevent the pull cables from moving.

As the spool subassembly 18 rotates in the first direction, the bearing subassembly 76 is positioned to transfer the rotational load from the spool subassembly 18 to the central shaft 19 which transfers the rotational load to the flywheel body 74. As a result, the flywheel 17 rotates with the spool subassembly 18 in the first direction as the user pulls on the pull cables. However, as the spool subassembly 18 rotates in the second direction imposed by the counterweights 20, 22 returning to their original positions, the bearing subassembly 76 is not positioned to transfer the rotational load from the spool subassembly 18 to the central shaft 19. Thus, no rotational load is transferred to the flywheel body 74. As a result, the flywheel 17 remains in its rotational orientation as the spool subassembly 18 rotates in the second direction. Consequently, the flywheel 17 moves in just the first direction.

While this example has been described with specific reference to the flywheel 17 rotating in just a single direction, in other examples the flywheel is arranged to rotate in multiple directions. Further, while this example has been described with reference to a specific arrangement of cables, pulleys, and counterweights, these components of the cable exercise machine 10 may be arranged in other configurations.

A sensor 80 can be arranged to track the rotational position of the flywheel 17. As the flywheel 17 rotates from the movement of the pull cables, the sensor 80 can track the revolutions that the flywheel rotates. In some examples, the sensor 80 may track half revolutions, quarter revolutions, other fractional revolutions, or combinations thereof.

The sensor 80 may be any appropriate type of sensor that can determine the rotational position of the flywheel 17. Further, the sensor 80 may be configured to determine the flywheel's position based on features incorporated into the flywheel body 74, the magnetically conductive rim 66, or the central shaft 19 of the flywheel 17. For example, the sensor 80 may be a mechanical rotary sensor, an optical rotary sensor, a magnetic rotary sensor, a capacitive rotary sensor, a geared multi-turn sensor, an incremental rotary sensor, another type of sensor, or combinations thereof. In some examples, a visual code may be depicted on the flywheel body 74, and the sensor 80 may read the position of the visual code to determine the number of revolutions or partial revolutions. In other examples, the flywheel body 74 includes at least one feature that is counted as the features rotate with the flywheel body 74. In some examples, a feature is a magnetic feature, a recess, a protrusion, an optical feature, another type of feature, or combinations thereof.

The sensor 80 can feed the number of revolutions and/or partial revolutions to a processor as an input. The processor can also receive as an input the level of resistance that was applied to the flywheel 17 when the revolutions occurred. As a result, the processor can cause the amount of energy or number of calories consumed to be determined. In some examples, other information, other than just the calorie count, is determined using the revolution count. For example, the processor may also determine the expected remaining life of the cable exercise machine 10 based on use. Such a number may be based, at least in part, on the number of flywheel revolutions. Further, the processor may also use the revolution count to track when maintenance should occur on the machine, and send a message to the user or another person indicating that maintenance should be performed on the machine based on usage.

In some examples, the sensor 80 is accompanied with an accelerometer. The combination of the inputs from the accelerometer and the sensor can at least aid the processor in determining the force exerted by the user during each pull. The processor may also track the force per pull, the average force over the course of the workout, the trends of force over the course of the workout, and so forth. For example, the processor may cause a graph of force per pull to be displayed to the user. In such a graph, the amount of force exerted by the user at the beginning of the workout versus the end of the workout may be depicted. Such information may be useful to the user and/or a trainer in customizing a workout for the user.

The number of calories per pull may be presented to the user in a display of the cable exercise machine 10. In some examples, the calories for an entire workout are tracked and presented to the user. In some examples, the calorie count is presented to the user through the display, through an audible mechanism, through a tactile mechanism, through another type of sensory mechanism, or combinations thereof.

Figure 7:
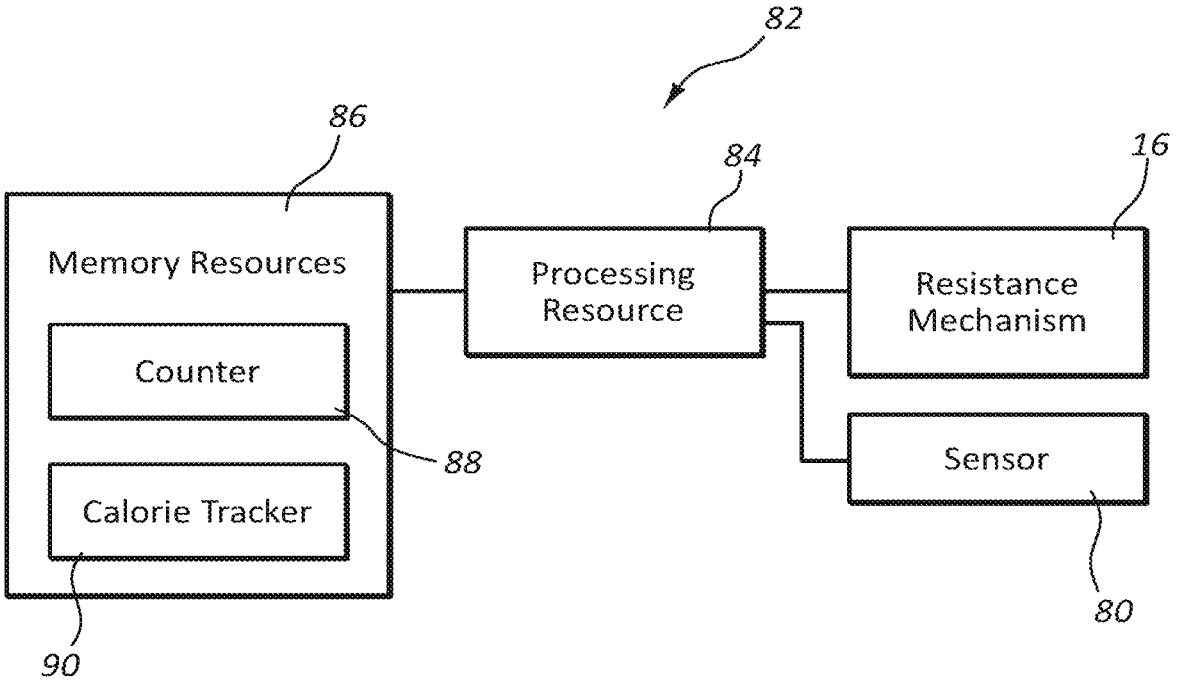
FIG. 7 illustrates a perspective view of an example of a tracking system of a cable exercise machine in accordance with the present disclosure.

FIG. 7 illustrates a perspective view of a tracking system 82 of a cable exercise machine 10 in accordance with the present disclosure. The tracking system 82 may include a combination of hardware and programmed instructions for executing the functions of the tracking system 82. In this example, the tracking system 82 includes processing resources 84 that are in communication with memory resources 86. Processing resources 84 include at least one processor and other resources used to process programmed instructions. The memory resources 86 represent generally any memory capable of storing data such as programmed instructions or data structures used by the tracking system 82. The programmed instructions shown stored in the memory resources 86 include a counter 88 and a calorie tracker 90.

The memory resources 86 include a computer readable storage medium that contains computer readable program code to cause tasks to be executed by the processing resources 84. The computer readable storage medium may be tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic storage media, other types of memory, or combinations thereof.

The counter 88 represents programmed instructions that, when executed, cause the processing resources 84 to count the number of revolutions and/or partial revolutions made by the flywheel 17. The calorie tracker 90 represents programmed instructions that, when executed, cause the processing resources 84 to track the number of calories burned by the user during this workout. The calorie tracker 90 takes inputs from at least the sensor 80 and the resistance mechanism to calculate the number of calories burned.

Further, the memory resources 86 may be part of an installation package. In response to installing the installation package, the programmed instructions of the memory resources 86 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources 84 and the memory resources 86 are located within the same physical component, such as the cable exercise machine 10 or a remote component in connection with the cable exercise machine 10. The memory resources 86 may be part of the cable exercise machine's main memory, caches, registers, non-volatile memory, or elsewhere in the physical component's memory hierarchy. Alternatively, the memory resources 86 may be in communication with the processing resources 84 over a network. Further, the data structures, such as the libraries, calorie charts, histories, and so forth may be accessed from a remote location over a network connection while the programmed instructions are located locally. Thus, information from the tracking system 82 may be accessible on a user device, on a server, on a collection of servers, or combinations thereof.

Figure 8:
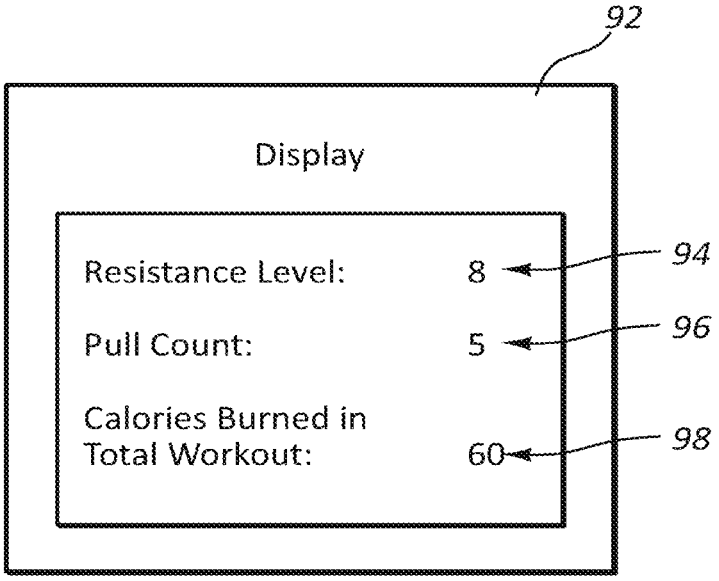
FIG. 8 illustrates a block diagram of an example of a display of a cable exercise machine in accordance with the present disclosure.

FIG. 8 illustrates a block diagram of a display 92 of a cable exercise machine 10 in accordance with the present disclosure. In this example, the display 92 includes a resistance level indicator 94, a pull count indicator 96, and a calorie indicator 98. The resistance level indicator 94 may be used to display the current resistance setting of the cable exercise machine 10.

The pull count indicator 96 may track the number of pulls that have been executed by the user. Such a number may track the time periods where the flywheel 17 is rotating, the number of periods when the flywheel 17 is not rotating, the time periods where the spool subassembly 18 is rotating in the first direction, the time periods where the spool subassembly 18 is rotating in the second direction, the movement of the counterweights 20, 22, another movement, or combinations thereof. In some examples, the cable exercise machine 10 has an ability to determine whether a pull is a partial pull or a full length pull. In such examples, the pull count indicator 96 may depict the total pulls and partial pulls.

The calorie indicator 98 may depict the current calculation of consumed calories in the workout. In some examples, the calorie count reflects just the input from the sensor 80. In other examples, the calorie count reflects the input from the flywheel assembly 16 and the sensor 80. In other examples, inputs from an accelerometer are input into the flywheel assembly 16, a pedometer worn by the user, another exercise machine (i.e. a treadmill or elliptical with calorie tracking capabilities), another device, or combinations thereof are also reflected in the calorie indicator 98.

While the above examples have been described with reference to a specific cable exercise machine with pulleys and cables for directing the rotation of the flywheel 17 and pull cables 30, 34, 38, 42, any appropriate type of cable pull machine may be used. For example, the cable exercise machine may use bearing surfaces or sprockets to guide the cables. In other examples, the cables may be partially made of chains, ropes, wires, metal cables, other types of cables, or combinations thereof. Further, the cables may be routed in different directions than depicted above.

INDUSTRIAL APPLICABILITY

In general, the invention disclosed herein may provide a user with the advantage of an intuitive energy tracking device incorporated into a cable exercise machine. The user can adjust his or her workout based on the number of calories consumed. Further, the user may use the calorie count to adjust his or her diet throughout the day. The cable exercise machine described above may also have the ability to track other information besides the calorie count, such as a force exerted per pull as well as track a maintenance schedule based on the flywheel's revolution count.

The level of resistance applied by the magnetic resistance mechanism of the present exemplary system can be finely controlled via electronic inputs. The inputs or outputs of these and other types of adjustable resistance mechanisms can be tracked and stored. The tracked level of resistance can then be sent to a calorie tracker. The calorie tracker can determine the amount of calories burned during each individual pull and/or a group of pulls collectively during the course of the entire workout based on the inputs about the flywheel position and the resistance level. This may provide a user with an accurate representation of the work performed on the cable exercise machine.

The present system may also provide a precise calculation of work performed during the workout, while providing the user the flexibility of using multiple resistance cables. The unique flywheel arrangement allows for the use of a single flywheel to resist the movement of multiple different resistance cables. According to the present configuration, the flywheel rotates in a single direction regardless of the direction that the pull cable is moving. Further, in this example, the flywheel is just rotating when a pull force is exerted by the user, thus the position of the flywheel represents just the work done as part of the workout. Further, the calorie counting calculations of the cable exercise machine are simplified because the sensor is insulated from at least the pull cable's return forces that may skew the calorie counting calculations. Consequently, the tracked calories can represent just those calories that are consumed during the course of the workout.

Additionally, the present exemplary system also determines the angular position of the flywheel during operation. Measuring the angular position of the flywheel provides advantages over merely measuring forces applied directly to the flywheel, such as torque or magnetic resistance. For example, angular position changes may be implemented in the calculation process. Further, the angular displacement of the flywheel may reflect the total interaction between all of the components of the flywheel assembly, which can provide a more accurate understanding of when the cable exercise machine ought to be flagged for routine service.

Such a cable exercise machine may include a tower that has the ability to position the ends of the pull cables at a location above the user's head. Further, the user has an ability to adjust the position of the cable ends along a height of the cable exercise machine so that the user can refine the muscle groups of interest. In the examples of the exercise machine disclosed above, the user has four pull cables to which the user can attach a handle. Thus, the user can work muscle groups that involve pulling a low positioned cable with a first hand while pulling a relatively higher positioned cable with a second hand. The pull cable ends can be adjusted to multiple positions when the magnetic flywheel is positioned in the middle of the cable exercise machine. This central location allows for the pull cables to be attached to the spool subassembly from a variety of angles.

The invention claimed is:

1. A cable exercise machine comprising:

a support;

a first pull cable routed through a first pulley supported by the support;

a second pull cable routed through a second pulley supported by the support;

a resistance unit linked to the first pull cable and to the second pull cable, the resistance unit configured to apply one or more levels of resistance to a user pulling on one or both of the first pull cable or the second pull cable; and a control panel configured to:

execute a workout based at least in part on user input at the control panel, determine a force exerted by the user during a pull of one or both of the first pull cable or the second pull cable, wherein the force is based at least in part on an applied level of resistance of the resistance unit and an amount rotation of the resistance unit during the pull, determine a calorie burn during the pull, wherein the calorie burn is determined for an extension of the one or both of the first pull cable or the second pull cable and not a retraction of the one or both of the first pull cable or the second pull cable, display workout information for the workout, the workout information including the force exerted by the user during the pull and the calorie burn during the pull, and display feedback regarding the user's performance during the workout.

2. The cable exercise machine of claim 1, wherein the control panel is further configured to display a trend of the force exerted by the user during each pull of the first pull cable and/or the second pull cable over the course of the workout.

3. The cable exercise machine of claim 1, wherein the control panel is further configured to display a graph of the force exerted by the user during each pull of the first pull cable and/or the second pull cable over the course of the workout.

4. The cable exercise machine of claim 3, wherein the graph depicts the force exerted by the user at the beginning of the workout versus the end of the workout.

5. A cable exercise machine comprising:

a support;

a first pull cable routed through a first pulley supported by the support;

a second pull cable routed through a second pulley supported by the support;

an resistance unit linked to the first pull cable and to the second pull cable, the resistance unit configured to apply one or more levels of resistance to a user pulling on the first pull cable and/or the second pull cable; and a control panel configured to:

execute a workout based at least in part on user input at the control panel, determine a force exerted by the user during a pull of one or both of the first pull cable or the second pull cable, wherein the force is based at least in part on an applied level of resistance of the resistance unit and an amount rotation of the resistance unit during the pull, determine a calorie burn during the pull, wherein the calorie burn is determined for an extension of the one or both of the first pull cable or the second pull cable and not a retraction of the one or both of the first pull cable or the second pull cable, display feedback regarding the user's performance during the workout, receive input from the user to play an audiovisual program, and play the audiovisual program for the user.

6. The cable exercise machine of claim 5, wherein:

the input from the user to adjust the level of resistance is received via a dial; and the adjusted level of resistance to the user is presented via a display.

7. The cable exercise machine of claim 5, wherein the control panel is further configured to:

receive input from the user to play music; and play the music for the user.

8. The cable exercise machine of claim 5, wherein the control panel is further configured to:

receive input from the user to execute a pre-programmed workout; and execute the pre-programmed workout for the user.

9. The cable exercise machine of claim 5, wherein the control panel is further configured to display a count of a number of times that the user pulled on the first pull cable and/or the second pull cable over the course of a workout.

10. The cable exercise machine of claim 5, wherein the control panel is further configured to:

determine whether a pull by the user on the first pull cable and/or the second pull cable is a partial pull or a full-length pull; and display a count that includes a number of times that the user performed a full-length pull, and excludes a number of times that the user performed a partial pull, on the first pull cable and/or the second pull cable over the course of a workout.

11. A cable exercise machine comprising:

a support;

a first vertical guide incorporated into the support;

a first pull cable routed through a first pulley, the first pulley movable along a length of the first vertical guide;

a second vertical guide incorporated into the support;

a second pull cable routed through a second pulley, the second pulley movable along a length of the second vertical guide;

an resistance unit linked to the first pull cable and to the second pull cable, the resistance unit configured to apply one or more levels of resistance to a user pulling on the first pull cable and/or the second pull cable; and a control panel configured to:

execute a workout based at least in part on user input at the control panel, determine a force exerted by the user during a pull of one or both of the first pull cable or the second pull cable, wherein the force is based at least in part on an applied level of resistance of the resistance unit and an amount rotation of the resistance unit during the pull, determine a calorie burn during the pull, wherein the calorie burn is determined for an extension of the one or both of the first pull cable or the second pull cable and not a retraction of the one or both of the first pull cable or the second pull cable, and display feedback regarding the user's performance during the workout.

12. The cable exercise machine of claim 11, wherein:

the first pull cable includes a first handle end equipped with a first handle connector that includes a first spring-loaded loop configured to have a first handle connected thereto; and the second pull cable includes a second handle end equipped with a second handle connector that includes a second spring-loaded loop configured to have a second handle connected thereto.

13. The cable exercise machine of claim 11, wherein:

the first pulley is movable along the length of the first vertical guide to customize a workout for a height of the user; and the second pulley is movable along the length of the second vertical guide to customize the workout for the height of the user.

14. The cable exercise machine of claim 11, wherein:

the first pulley is movable along the length of the first vertical guide to customize a workout for a desired target muscle group of the user; and the second pulley is movable along the length of the second vertical guide to customize the workout for the desired target muscle group of the user.

15. The cable exercise machine of claim 11, wherein:

the first vertical guide extends from an upper left location of the support to a lower left location of the support; and the second vertical guide extends from an upper right location of the support to a lower right location of the support.

16. The cable exercise machine of claim 15, wherein:

the first pulley is further rotatable from side to side on the first vertical guide; and the second pulley is further rotatable from side to side on the second vertical guide.

17. The cable exercise machine of claim 15, wherein the first pulley is movable to the lower left location while the second pulley is movable to the upper right location.

18. The cable exercise machine of claim 11, wherein the control panel is incorporated into an outer covering of the support.

19. The cable exercise machine of claim 11, wherein:

the first vertical guide comprises a first vertical guide bar; and the second vertical guide comprises a second vertical guide bar.

20. The cable exercise machine of claim 11, wherein the control panel is further configured to display the calorie burn during the workout by the user.

* * * * *